US009676572B2

(12) United States Patent
Kaiga

(10) Patent No.: US 9,676,572 B2
(45) Date of Patent: Jun. 13, 2017

(54) SHEET CONVEYING APPARATUS AND IMAGE FORMING APPARATUS

(71) Applicant: CANON KABUSHIKI KAISHA, Tokyo (JP)

(72) Inventor: Miho Kaiga, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/677,001

(22) Filed: Apr. 2, 2015

(65) Prior Publication Data

US 2015/0284199 A1 Oct. 8, 2015

(30) Foreign Application Priority Data

Apr. 3, 2014 (JP) ..... 2014-076750

(51) Int. Cl.

| | |
|---|---|
| ***B65H 85/00*** | (2006.01) |
| ***B65H 5/06*** | (2006.01) |
| ***B65H 5/36*** | (2006.01) |
| ***B65H 5/38*** | (2006.01) |

(Continued)

(52) U.S. Cl.

CPC ..... *B65H 5/062* (2013.01); *B65H 5/36* (2013.01); *B65H 5/38* (2013.01); *B65H 9/006* (2013.01); *B65H 9/06* (2013.01); *B65H 2301/4452* (2013.01); *B65H 2404/6111* (2013.01); *B65H 2404/651* (2013.01); *B65H 2404/653* (2013.01)

(58) Field of Classification Search

CPC ..... B65H 2404/65; B65H 2404/651; B65H 2404/652; B65H 2404/653; B65H 2404/654; B65H 2301/4452

USPC ..... 271/245, 246

See application file for complete search history.

(56) References Cited

U.S. PATENT DOCUMENTS

| | | | | |
|---|---|---|---|---|
| 6,564,966 | B2 | 5/2003 | Kaiga et al. | |
| 7,681,882 | B2 * | 3/2010 | Yu | B65H 9/006 271/243 |
| 8,540,239 | B2 | 9/2013 | Kaiga et al. | |

(Continued)

FOREIGN PATENT DOCUMENTS

| | | | |
|---|---|---|---|
| CN | 102574946 | A | 7/2012 |
| EP | 2492226 | A1 | 8/2012 |

(Continued)

OTHER PUBLICATIONS

Copending unpublished U.S. Appl. No. 14/676,003, to Miho Kaiga, filed Apr. 1, 2015.

(Continued)

*Primary Examiner* — Howard Sanders

(74) *Attorney, Agent, or Firm* — Fitzpatrick, Cella, Harper & Scinto

(57) ABSTRACT

A sheet conveying apparatus includes a first rotator pair, a second rotator pair provided downstream, in a sheet conveying direction, of the first rotator pair, and a moving member having an abutment portion. the first rotator pair, the second rotator pair and the moving member are configured such that a rear end of the sheet does not pass on a moving trajectory of the abutment portion when the moving member moves from a passage state in which the sheet is allowed to pass through the abutment portion as the abutment portion is pressed by the sheet conveyed by the first rotator pair to an abutment state in which the abutment portion protrudes into a sheet conveying path.

12 Claims, 16 Drawing Sheets

(51) Int. Cl.
*B65H 9/00* (2006.01)
*B65H 9/06* (2006.01)

(56) References Cited

U.S. PATENT DOCUMENTS

| | | | | |
|---|---|---|---|---|
| 2009/0184461 | A1* | 7/2009 | Ishikawa | B65H 5/062 271/254 |
| 2011/0089628 | A1 | 4/2011 | Watanabe et al. | |
| 2012/0093554 | A1* | 4/2012 | Suzuki | B65H 7/02 399/381 |
| 2013/0087968 | A1 | 4/2013 | Watanabe et al. | |
| 2014/0077441 | A1 | 3/2014 | Watanabe et al. | |

FOREIGN PATENT DOCUMENTS

| | | | |
|---|---|---|---|
| JP | 5318221 | B2 | 10/2013 |
| KR | 20120062937 | A | 6/2012 |
| WO | 2011048668 | A1 | 4/2011 |

OTHER PUBLICATIONS

Copending unpublished U.S. Appl. No. 14/677,016, to Taku Nishikawa, et al., filed Apr. 2, 2015.

* cited by examiner

SHEET CONVEYING APPARATUS AND IMAGE FORMING APPARATUS

BACKGROUND OF THE INVENTION

Field of the Invention

This disclosure relates to a sheet conveying apparatus conveying a sheet and an image forming apparatus.

Description of the Related Art

In the related art, image forming apparatuses such as copiers, printers, and facsimiles include an image forming portion, and a sheet conveying apparatus configured to convey a sheet to the image forming portion by conveyance rollers. In the image forming apparatus of the related art, there are cases where a sheet is skewed when the sheet is conveyed due to a conveyance roller being deformed, alignment of the conveyance roller being deviated, or the like. Here, in the image forming apparatus, accuracy of an image forming position considerably depends on a position of a sheet relative to the image forming portion, and thus a major image quality factor is to match a position of the sheet with the image forming portion with high accuracy.

Therefore, in the image forming apparatus of the related art, a skew correcting portion is provided in the sheet conveying apparatus, and the skew of the sheet is corrected by the skew correcting portion, whereby an accuracy of the image forming position is improved. Examples of the skew correcting portion include the one provided with a shutter member biased in a direction opposite to a sheet conveying direction by a biasing portion such as a spring, for example, and configured to cause a front end of the sheet to come into contact with the shutter member.

As described in Japanese Patent No. 5318221, a shutter-type skew correcting portion including a plurality of shutter members is proposed. The plurality of shutter members is provided rotatably coaxially with a shaft of a conveyance driven roller and each of the shutter members has a plurality of abutment surfaces on a peripheral surface thereof. In the skew correcting portion of this configuration, when a forefront portion of the front end of the skewed sheet comes into abutment with the abutment surface of one of the plurality of shutter members, the sheet is stopped in a state of being in abutment with the abutment surface by receiving a reaction force from the abutment surface. Subsequently, when the sheet is further conveyed, the sheet is deflected. As a result of deflection of the sheet in this manner, the front end of the sheet comes into abutment with the abutment surfaces of the plurality of shutter members. Accordingly, the skew of the sheet is corrected, and subsequently, the sheet corrected the skewness enters a nip between the conveyance roller and the conveyance driven roller, and is conveyed to downstream.

Meanwhile, in recent years, there has been a demand for improvement in the productivity, that is, improvement in the number of sheets on which images are formed per unit time in the image forming apparatus. For this reason, a sheet conveyance speed has been increased, or an interval (hereinafter, referred to as an inter-sheet distance) between a rear end of a sheet and a front end of the following sheet, the sheets being continuously conveyed, has been reduced. In association with the increase in sheet conveyance speed and shortening of the inter-sheet distance as described above, the shutter member is required to return back to a skew correction position in a short inter-sheet distance after the preceding sheet has passed through.

For instance, when the skew of a preceding sheet is corrected, the shutter member of the related art rotates by being pressed by the sheet. When the shutter member is rotated by a predetermined distance, the shutter member is moved toward a position where the skew of the sheet conveyed subsequently is corrected by a following abutment surface, by a cam portion or the like. Even though the shutter member is moved in this manner, the following abutment surface is in contact with an upper surface of the conveyed sheet until the rear end of the preceding sheet passes through the following abutment surface.

Therefore, the movement of the following sheet abutment surface to the position for correcting a sheet skew is performed after the rear end of the preceding sheet passes the shutter member. Thus, the inter-sheet distance between the preceding and succeeding sheets is required to be set such that the front end of the succeeding sheet does not reach the shutter member during a period from when the rear end of the preceding sheet passes through the shutter member until when the following abutment surface moves to the position for correcting the skew of the sheet.

SUMMARY OF THE INVENTION

According to an aspect of the present disclosure, there is provided a sheet conveying apparatus including a first rotator pair conveying a sheet, a second rotator pair provided downstream, in a sheet conveying direction, of the first rotator pair, an a moving member having an abutment portion against which a front end of the sheet conveyed by the first rotator pair abuts, and being movable from an abutment state in which the abutment portion protrudes into a sheet conveying path at upstream, in the sheet conveying direction, of a nip portion of the second rotator pair to a passage state in which the sheet is allowed to pass through the abutment portion as the abutment portion is pressed by the sheet conveyed by the first rotator pair. The first rotator pair, the second rotator pair and the moving member are configured such that a rear end of the sheet does not pass on a moving trajectory of the abutment portion when the moving member moves from the passage state to the abutment state.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Figure 1:
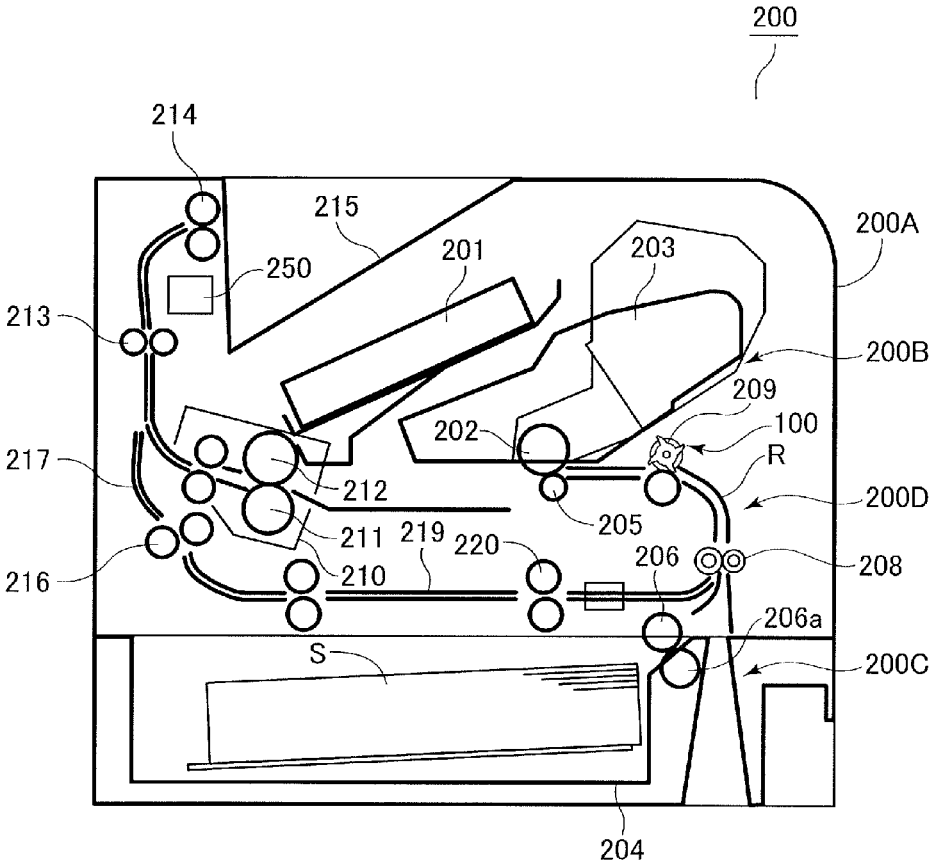
FIG. 1 is a drawing illustrating a schematic configuration of a laser printer as an example of an image forming apparatus provided with a sheet conveying apparatus of a first embodiment.

A mode for implementing this disclosure will be described with reference to the drawings. FIG. 1 is a drawing illustrating a schematic configuration of a laser printer as an example of an image forming apparatus provided with a sheet conveying apparatus according to a first embodiment of this disclosure. In FIG. 1, reference numeral 200 denotes a laser printer, reference numeral 200A denotes a laser printer body (hereinafter, referred to as an apparatus body), and reference numeral 200B denotes an image forming portion provided on the apparatus body 200A.

Reference numeral 200C denotes a sheet feeding apparatus provided on a lower portion of the apparatus body 200A, and reference numeral 200D denotes a sheet conveying apparatus provided with a skew correcting portion 100, and configured to correct a skew of a sheet fed from the sheet feeding apparatus 200C by the skew correcting portion 100 and convey the sheet to the image forming portion 200B. Reference numeral 250 denotes a control portion provided at a predetermined position in the apparatus body 200A and configured to control an image forming operation of the image forming portion 200B and a sheet conveyance operation of the sheet conveying apparatus 200D.

The image forming portion 200B includes a cartridge unit 203 having a photoconductive drum 202 as an image carrier, and a laser scanner 201 configured to expose the photoconductive drum 202. In the case of the image formation, the photoconductive drum 202 is exposed by the laser scanner 201 to form a latent image on a surface of the photoconductive drum and, subsequently, a toner image is formed on the surface of the photoconductive drum by developing the latent image.

The sheet feeding apparatus 200C includes a sheet feeding cassette 204 as a sheet stacking portion provided so as to be drawable with respect to the apparatus body 200A, and a sheet feed roller 206 provided above the sheet feeding cassette 204 and configured to feed a sheet S stored in the sheet feeding cassette 204. The sheet feeding apparatus 200C includes a separating roller 206*a* coming into pressure contact with the sheet feed roller 206 and configuring a separating portion to separate the sheet S fed by the sheet feed roller 206.

The sheet feeding apparatus 200C configured in this manner feeds the sheet S stored in the sheet feeding cassette 204 by the sheet feed roller 206 in parallel to a toner image forming operation of the image forming portion 200B described above. The sheets are separated by the separating roller 206*a* one by one. The separated sheet S is conveyed to the skew correcting portion 100 by a first conveyance roller pair 208 of the sheet conveying apparatus 200D provided on a sheet conveying path R. The skewed sheet S is corrected by the skew correcting portion 100, and then the sheet S is conveyed to a transfer unit formed by the photoconductive drum 202 and a conveyance roller 205.

At the transfer unit, the toner image formed on the surface of the photoconductive drum is transferred to the sheet S conveyed to the transfer unit, and subsequently, the sheet S is fed to a fixing portion 210 including a drive roller 211 and a fixing roller 212 provided with a heater integrated therein. The toner image is heated and pressurized when passing through the drive roller 211 and the fixing roller 212, and hence the toner image is fixed onto the sheet S. The sheet S after the fixation is discharged onto a discharge tray 215 by an inner discharge roller pair 213 and an outer discharge roller 214.

In contrast, when forming an image also on a second surface, the sheet having the image formed on one surface passes through the fixing portion 210, and then is subjected to a switch back conveyance by a reverse rotation of the inner discharge roller pair 213 and the outer discharge roller pair 214. The sheet S is then conveyed again to the transfer unit by conveyance rollers 216 and 220 provided in a reverse conveying path 219 in a state in which the skew is corrected by the skew correcting portion 100. At the transfer unit, an image is formed on an opposite surface, and then the sheet is discharged onto the discharge tray 215.

Figure 2:
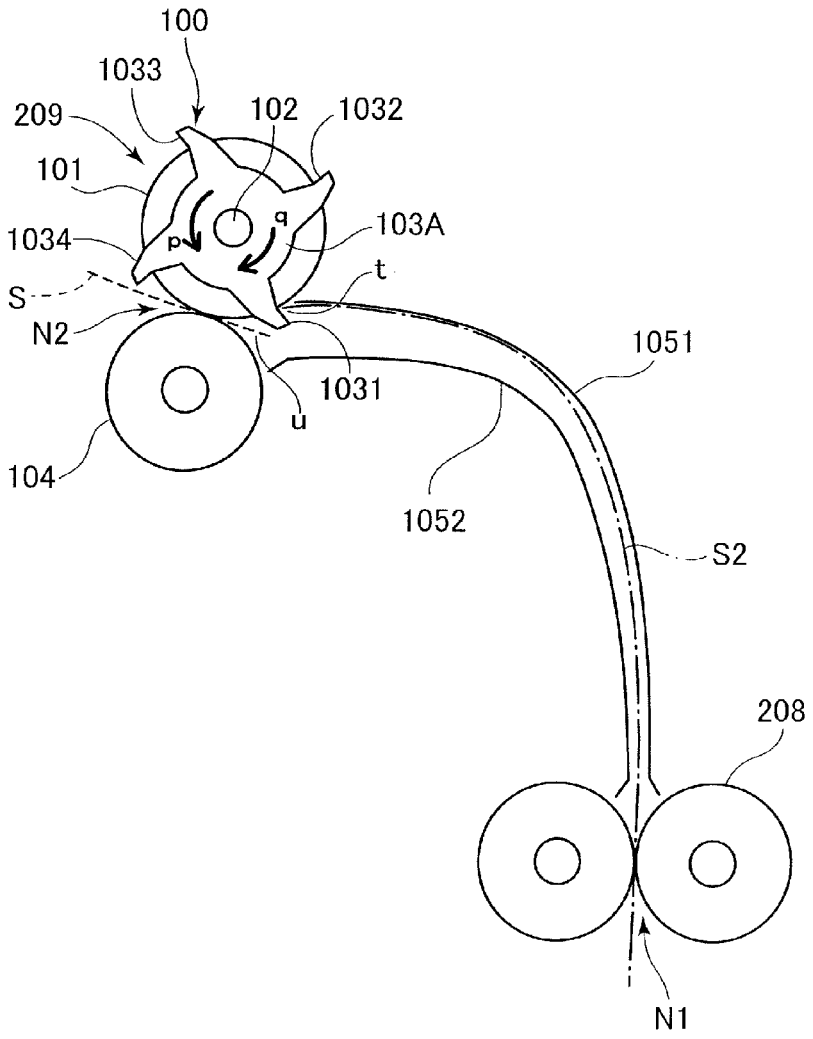
FIG. 2 is a drawing for explaining a configuration of a skew correcting portion provided in the sheet conveying apparatus.

As illustrated in FIG. 2, the skew correcting portion 100 includes a plurality of second conveyance roller pairs 209 and a plurality of shutter members 103. Each of second conveyance roller pairs 209 includes a drive roller 104 and a driven roller 101 configured to come into press contact with the drive roller 104 and to be driven in association with the rotation of the drive roller 104. The drive roller 104 is a first rotator provided on the same side with the shutter member 103 with respect to a nip portion N2 of the second rotator pair 209. The driven roller 101 is a second rotator disposed opposite to the driven roller 101 and a plurality of the driven rollers 101 are arrayed in an axial direction and rotatably supported by a conveyance frame 20 as illustrated in FIGS. 3A to 3C and FIG. 4. Each of driven rollers 101 is provided so as to have gap between its inner diameter portion and a shutter shaft 102 extending substantially coaxially. Thereby the driven rollers 101 do not come into contact with the shutter shaft 102.

More specifically, in this embodiment, the skew correcting portion 100 includes four sets of the second conveyance roller pairs 209 and four shutter members 103 (103A to 103D). The shutter members 103 are axially fixed onto the shutter shaft 102 at the same phase and are supported so as to be rotatable with respect to the conveyance frame 20. Here, each of the shutter members 103 includes at least one, four in this embodiment, protruding portions 1031 to 1034 each of which is configured to temporarily stop a front end of the sheet S by abutment therewith for correcting the skew of the sheet as illustrated in FIG. 2. That is, each of shutter members 103 is a rotator including four protruding portions 1031 to 1034 each of which protrudes from an outer periphery and these protruding portions 1031 to 1034 configure an abutment portion against which a front end of the sheet conveyed by the first conveyance roller pair 208 abuts in this embodiment.

As illustrated in FIG. 2, each phase position where one of the protruding portions 1031 to 1034 comes into abutment with the front end of the conveyed sheet S is referred to as a skew correction standby position, hereinafter. Also, the phase positions where the first through forth protruding portions 1031 through 1034 protrude into the sheet conveying path R at upstream, in the sheet conveying direction, of the nip portion N2 of the second conveying roller pair 209 are refereed to first through fourth abutment positions respectively.

Figure 4:
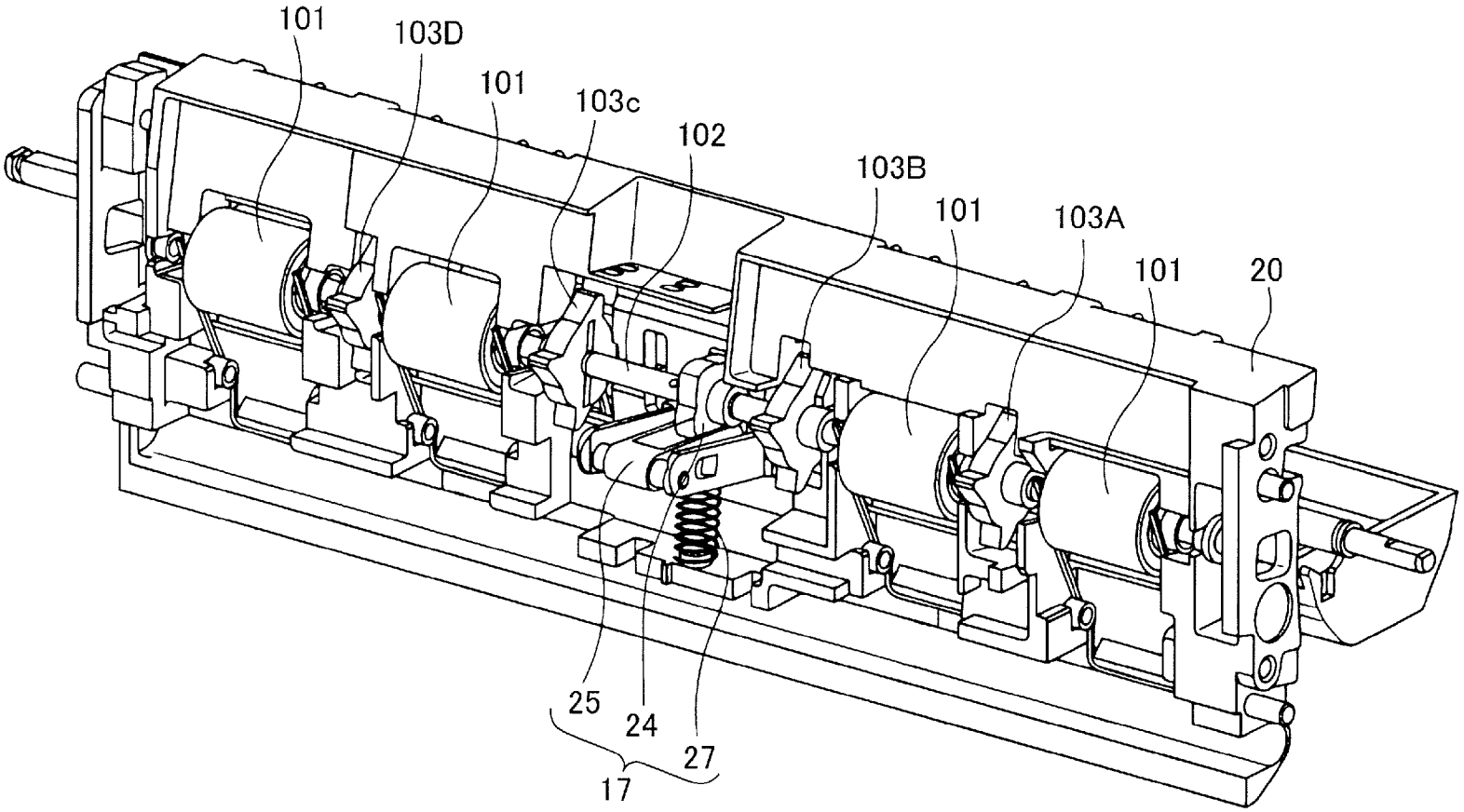
FIG. 4 is a perspective view illustrating the configuration of the skew correcting portion.

Furthermore, as described in FIG. 4, the skew correcting portion 100 includes a positioning mechanism 17 positioning the plurality of shutter members 103 at predetermined rotational positions. The positioning mechanism 17 includes a cam member 24 fixed onto the shutter shaft 102, a bias arm 25 biasing the cam member 24, and a bias spring 27 biasing the bias arm 25. The cam member 24 has the same number of cams (four in the present embodiment) with the protruding portions 1031 through 1034. The cams are formed such that the protruding portions 1031 through 1034 are positioned at the standby position. That is, the cam member 24 is formed of four sets of a resistance side cam surface and a driving side cam surface formed with a top dead point between them by its outer circumferential surface and has four bottom dead points corresponding to the first through fourth abutment positions (between the driving side cam surface and the adjacent resistance side cam surface). The bias arm 25 includes a cam follower in contact with the cam (the set of the resistance side and driving side cam surfaces) of the cam member 24 and oscillates in a state biased by the bias spring 27 to position the cam member 24 to a predetermined position (bottom dead point) such that the protruding portions 1031 through 1034 are positioned at the standby position. That is, the shutter members 103 are configured to stop at the respective skew correction standby positions by retaining forces of the cam member 24. The shutter members 103 rotate in a direction q about the shutter shaft 102 when one of the protruding portions 1031 to 1034 is pressed by the sheet S by a force larger than the retaining force of the cam member. When the rotation is advanced by an angle larger than a predetermined angle, the following protruding portion 1032 is positioned at the skew correction standby position by the retaining force of the cam member 24.

As described above, each of the shutter members 103 turn to an abutment state in which the abutment portion protrudes into the sheet conveying path R at upstream, in the sheet conveying direction, of the nip portion N2 of the second conveying roller pair 209 by being positioned one of the first through forth positions. And the shutter member 103 is the rotators being movable from the abutment state to a passage state in which the sheet is allowed to pass through the abutment portion as the abutment portion is pressed by the sheet conveyed by the first conveying roller pair 208. For instance, the shutter member 103 turns to the abutment state when the first protruding portion 1031 protrudes into the sheet conveying path R at upstream, in the sheet conveying direction, of the nip portion N2 of the second rotator pair 209, and rotates until when the shutter member 103 turns again to the abutment state, through the passage state on a halfway, by the second protruding portion 1032 protruding into the sheet conveyance path R at upstream in the sheet conveying direction of the nip portion N2 of the second rotator pair 209 as the first protruding portion 1031 being pressed by the sheet.

It is noted that while the present embodiment is explained by exemplifying the skew correcting portion 100 includes the four second conveyance roller pairs 209 and the four shutter members 103, a number of the second conveyance roller pairs 209 and the shutter members are not limited to four. Also, while the present embodiment is explained by exemplifying the shutter member 103 includes the four protruding portions 1031 to 1034, a number of the protruding portions is not limited to four. Also, In FIG. 2, reference numeral 1051 denotes a conveyance guide (first conveyance guide), provided between the first conveyance roller pair 208, i.e., the first rotator pair, and the second conveyance roller pair 209, i.e., the second rotator pair, and the conveyance guide 1051 configures part of the sheet conveying path R. As illustrated in FIG. 2, a direction of a nip line indicating the sheet conveying direction at a nip portion N1 of the first conveyance roller pair 208 and a direction of a nip line indicating the sheet conveying direction at the nip portion N2 of the second conveyance roller pair 209 are different. In this manner, the conveyance guide 1051 has a curved shape so as to guide the sheet S conveyed by the first conveyance roller pair 208 having different direction of the nip line to the second conveyance roller pair 209. It is noted that the nip line refers to a straight line orthogonal to a straight line connecting centers of rotation of the first and second rollers of the rotator pair and is a tangential line of the roller at the nip portion.

Reference numeral 1052 denotes an counter conveyance guide (a second conveyance guide, an counter guide portion) arranged so as to face the conveyance guide 1051. These conveyance guide 1051 and counter conveyance guide configure a guide portion 105 that forms the sheet conveyance path R between the first and second conveying roller pairs 208 and 209 in this embodiment. In other words, the guide portion 105 curvedly forms the sheet conveying path R between the first and second conveying roller pairs 208 and 209 such that a curvature of a side of the driven roller (first rotator) 101 is larger than that of a side of the driving roller (second rotator).

The shutter members 103 are positioned above the nip line of the second conveyance roller pair 209 and arranged such that a gap is formed between tips of the protruding portions 1031 to 1034 and the counter conveyance guide 1052 in the thickness direction of the sheet. In the case where the protruding portions 1031 to 1034 are arranged at the position as described above, the sheet S conveyed while being guided by the conveyance guide 1051 comes into abutment with the protruding portions 1031 to 1034 at a position indicated by reference sign t.

Hereinafter, the position t where the front end of the sheet S conveyed by being guided by the conveyance guide 1051 comes into abutment with the protruding portions 1031 to 1034 is referred to as a front end passing position t. As described later, the sheet S conveyed by the first conveyance roller pair 208 is passed to the second conveyance roller pair 209, the sheet S passes through a conveyance passage route u, which is on the nip line of the second conveyance roller pair 209.

In other words, the sheet S is conveyed while being guided by the conveyance guide 1051 and reaches the front end passing position t, and then passes through the second conveyance roller pair 209 via the conveyance passage route u which is a different route from the route before.

In this embodiment, the sheet conveying direction when passing through the conveyance passage route u is set to form an obtuse angle with respect to a guiding direction of the conveyance guide 1051 in a positive direction, i.e., counterclockwise direction. That is, the second conveyance roller pair 209 is configured such that a nip line, which is a tangent line of the nip portion, of the conveyance roller pair 209 is inclined in a direction approaching to a side of the driven roller 101 from a side of the driving roller 104 as the nip line advances upstream to downstream in the sheet conveying direction when viewed from a direction of a rotation axis of the second rotator pair.

Accordingly, the sheet can be moved away from the shutter members 103 before the rear end of the sheet, which is the upstream end of the sheet conveying direction, passes the shutter members 103.

Also, the second conveyance roller pair 209 is arranged such that the nip line of the second conveyance roller pair 209 does not intersect with the protruding portion (abutment portion) of the shutter member 103 in the abutment state when viewed from a direction of a rotation axis of the second conveyance roller pair 209.

Figure 5A:
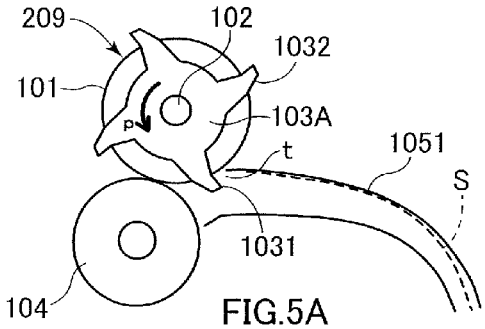
FIG. 5A is a side view illustrating a state in which the sheet is conveyed toward the shutter member.

Subsequently, a skew correcting operation of the skew correcting portion 100 configured in this manner will be described. FIG. 5A is a drawing illustrating a state before the front end of the sheet S reaches the skew correcting portion 100, that is, a state before the sheet S comes into abutment with the protruding portion 1031 of the shutter member 103A. Although not illustrated, the other shutter members 103B to 103D perform the same operation.

At this time, the shutter member 103A is positioned at the skew correction standby position, which is contact position which come into abutment with the sheet at upstream of the nip portion N2 of the second conveyance roller pair 209 in the sheet conveying direction.

Figure 3A:
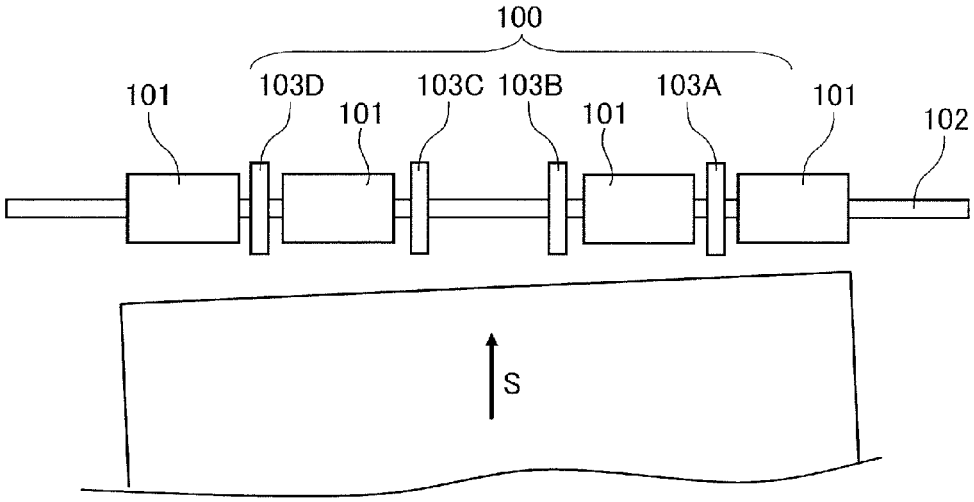
FIG. 3A is a plane view for explaining a skew correcting operation of the skew correcting portion.
Figure 3B:
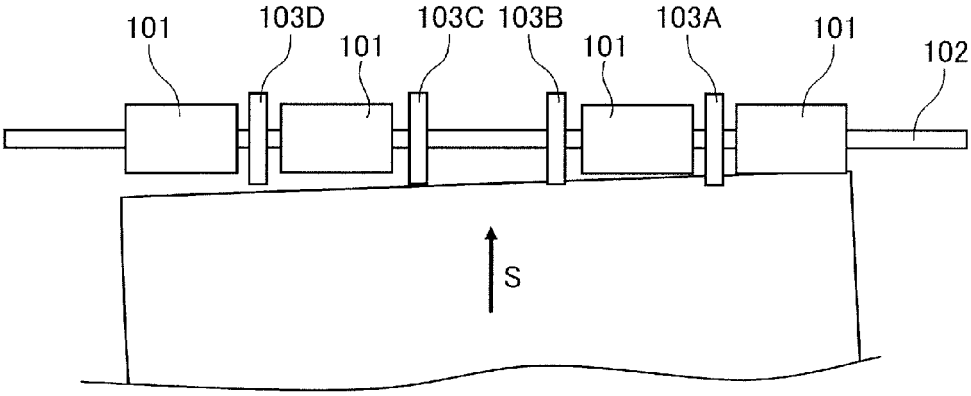
FIG. 3B is a plane view illustrating a state in which a forefront portion of a front end of a sheet abuts with a shutter member.
Figure 5B:
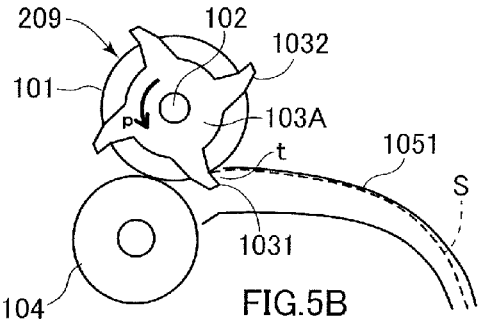
FIG. 5B is a side view illustrating a state in which the sheet abuts against the shutter member.

The sheet S conveyed to the first conveyance roller pair 208 by the sheet feed roller 206 and conveyed along the conveyance guide 1051 by the first conveyance roller pair 208 finally reaches the front end passing position t as illustrated in FIG. 5B. At this time, in the case where the sheet is skewed in a state in which the right side of the sheet S goes ahead as illustrated in FIG. 3A, the sheet S passes through the front end passing position t along the conveyance guide 1051. The sheet S comes into abutment with the protruding portion 1031 of the shutter member 103A out of the shutter members 103A to 103D positioned on one end side in a width direction as illustrated in FIG. 3B.

Figure 3C:
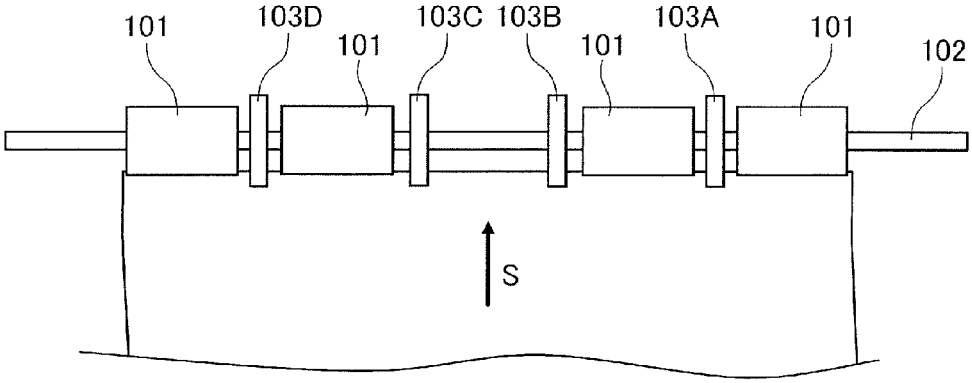
FIG. 3C is a plane view illustrating a state in which the front end of a sheet abuts with the shutter members and the skew of the sheet is corrected.
Figure 5C:
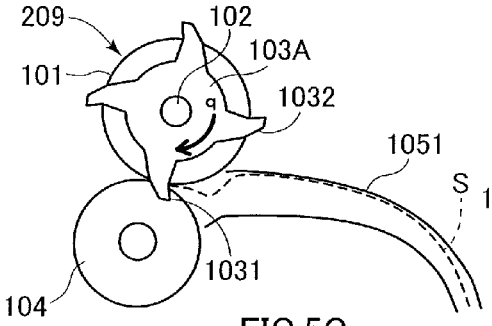
FIG. 5C is a side view illustrating a state in which a loop of the sheet is formed by the sheet being pushed against the shutter member.

At this time, the shutter member 103A receives a biasing force in a direction p by a biasing portion 25 and 27. Therefore, the front end of the sheet S is stopped by coming into contact with the protruding portion 1031, forms a loop as illustrated in FIG. 5C, and comes into abutment with the protruding portions 1031 of other shutter members 103B to 103D in sequence as illustrated in FIG. 3C. By bringing the front end of the sheet S into contact with the protruding portions 1031 of all of the shutter members 103A to 103D, the front end of the sheet S is aligned with one straight line parallel to the shutter shaft 102 and the skew is corrected.

In addition, stiffness of the sheet S is getting grater in association with the subsequently grow of the loop, whereby the shutter member 103A is pressed by the sheet S. When the shutter member 103A is pressed by the sheet S with a predetermined pressure or higher, the shutter member 103A rotates about the shutter shaft 102, and move to the passing positions where the sheet is entered into the nip portion N2 of the second conveyance roller pair 209.

Figure 5D:
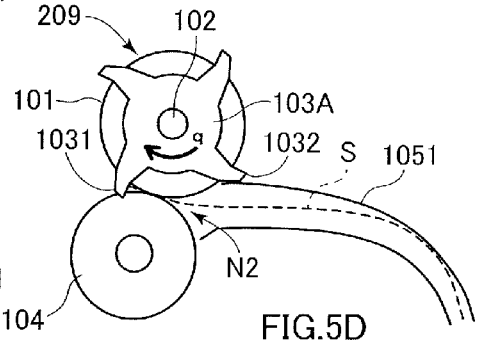
FIG. 5D is a side view illustrating a state in which the shutter member rotates by being pressed by the sheet.
Figure 5E:
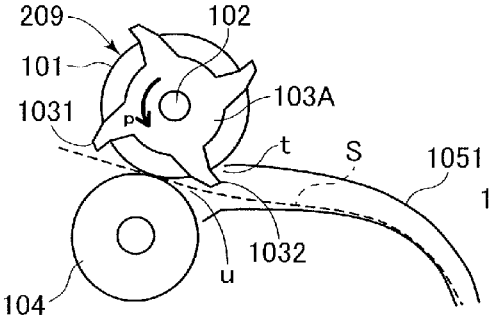
FIG. 5E is a side view illustrating a half-way state when the sheet passes through the shutter member.

Accordingly, the front end of the sheet S enters into the nip portion N2 of the second conveyance roller pair 209 as illustrated in FIG. 5D while the skew of the front end of the sheet S is corrected. In this case, a conveyance route of the sheet S is moved from a route along the conveyance guide 1051 up to the front end passing position t to the conveyance passage route u, which is on the nip line of the second conveyance roller pair 209 as illustrated in FIG. 5E. The shutter member 103A continuously rotates with the pressure exerted by the front end of the sheet S in this time.

When the conveyance passage route u is moved, the sheet conveying direction when passing through the conveyance passage route u is set to become an obtuse angle with respect to the guiding direction guided by the conveyance guide 1051 in the positive direction, so that the sheet S moves in the direction away from the shutter member 103A. Here, the first conveyance roller pair 208, the second conveyance roller pair 209 and the shutter member 103 are configured such that a rear end of the sheet does not pass on a moving trajectory of the second protruding portion 1032 when the shutter member 103 moves from the passage state to the abutment state. Therefore, the shutter member 103 can move from the first position to the second position without interference with the sheet when the sheet is conveyed by the second conveyance roller 209. Thus, when the conveyance of the sheet S is advanced and the shutter member 103A rotates by a predetermined angle or more, the shutter member 103A is rotated until the protruding portion 1032 reaches the skew correction standby positions, and then are stopped by the cam member. Accordingly, correction of the skew of a front end of a following sheet S2 of the shutter member 103A is ready to be started.

Figure 5F:
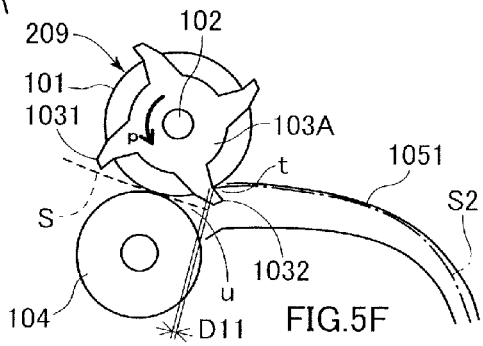
FIG. 5F is a side view illustrating a state in which a rear end of the sheet passes through the shutter member.

In this embodiment, feed of the following sheet is started while the sheet S is being conveyed, and the sheet fed next is conveyed by the first conveyance roller pair 208 along the conveyance guide 1051. As illustrated in FIG. 5F, the following sheet S2 comes into abutment with the protruding portion 1032 positioned at the skew correction standby position of any one of the shutter members 103 at the front end passing position t. When the conveyance is continued, the correction of the skew of the following sheet S2 is started in the same manner as the sheet S.

At this time, since the shutter members 103 are positioned at the skew correction standby positions and vibration and the like are over before the front end of the following sheet S2 reaches the protruding portion 1032, the state in which start of the correction of the skew of the following sheet is allowed is achieved. Accordingly, the skew of the following sheet S2 may be corrected irrespective of the position of a rear end of the preceding sheet S. Consequently, a distance D11 between the rear end of the preceding sheet S and the front end of the sheet S2 may be caused to approach 0.

As described above, in this embodiment, an angle of the sheet conveying direction of the second conveyance roller pair 209 is set to be an obtuse angle with respect to the guiding direction of the conveyance guide 1051 in the positive direction. Accordingly, the sheet moves away from the shutter members 103 from after the passage of the front end of the sheet through the front end passing position until the rear end passes the shutter member 103A moved to the passing position, whereby each of the shutter members 103 is moved to the skew correction standby position. Consequently, a state in which the skew correction of the following sheet can be started is assumed before the rear end of the sheet leaves the shutter members 103 completely. That is, the shutter member 103 turns from the passage state to the abutment state before the rear end of the sheet passes through the shutter member 103 after when the moving member has turned to the passage state by being pressed by the front end of the sheet, so that the correction of the skew is enabled in a shorter inter-sheet distance in comparison with the related art.

In other words, before the rear end of the sheet passes through the shutter members 103, the sheet is moved away from the shutter members 103 and the shutter members 103 are moved to the skew correction standby positions. Accordingly, even when the sheet conveyance speed is high, the skew of the sheet may be corrected in a short inter-sheet distance. Since the correction of the skew of the sheet is enabled even in the short inter-sheet distance, the number of sheets on which the images are to be formed may be increased. In addition, by bringing the sheet into a state of being away from the shutter members 103 before the rear end passes, damage or bending of the sheet S caused by the shutter members 103 may be prevented. In addition, when a user pulls out the sheet S in clearing of jams, the sheet S is prevented from being caught by the shutter members 103 and being damaged thereby.

Figure 6:
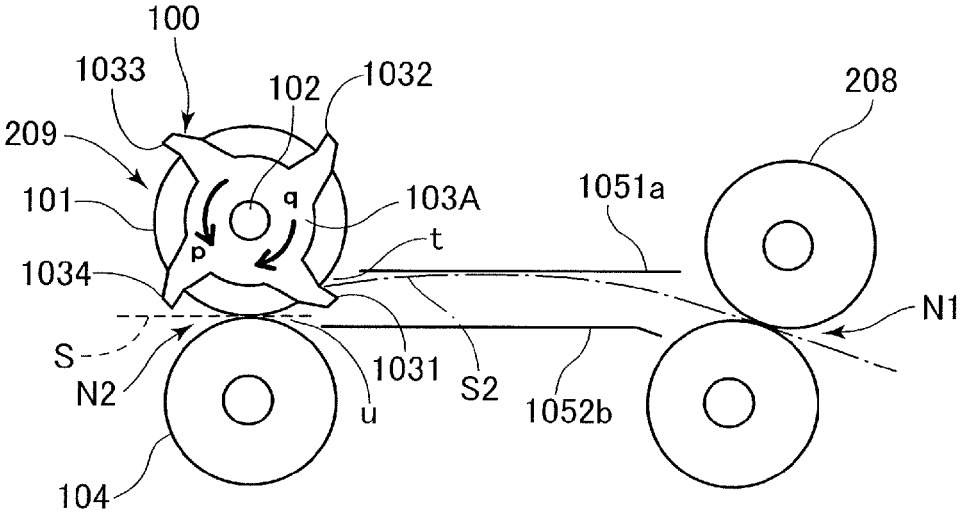
FIG. 6 is a drawing illustrating a configuration of a sheet conveying apparatus of a second embodiment.

Subsequently, a second embodiment of this disclosure will be described. FIG. 6 is a drawing illustrating a configuration of the sheet conveying apparatus of this embodiment. In FIG. 6, the same reference signs as in FIG. 2 described already indicate the same or equivalent portions. In FIG. 6, reference signs 105*a* and 105*b* denote first and second conveyance guides provided between the first conveyance roller pair 208 and the second conveyance roller pair 209 so as to face to each other, having a straight shape, and constituting part of the sheet conveying path R.

In this embodiment, the direction of the nip line of the first conveyance roller pair 208 corresponds to a direction of bringing the conveyed sheet into contact with the first conveyance guide 1051*a*. That is, the first conveyance roller pair 208 is arranged such that the nip line, which is a tangent line of a nip portion, of the first conveyance roller pair 208 is inclined in a direction approaching to the side of driven roller 101 from the side of the drive roller 104 as the nip line advances upstream to downstream in the sheet conveying direction. Unlike the direction of the nip line of the first conveyance roller pair 208, the direction of the nip line of the second conveyance roller pair 209 is parallel to the first conveyance guide 1051*a*. The conveyance passage route u is set on a substantially imaginably straight line connecting the nip portion N2 of the second conveyance roller pair 209 and the nip portion N1 of the first conveyance roller pair 208.

In addition, in this embodiment, a sheet conveyance speed of the second conveyance roller pair 209 is set to be higher than a sheet conveyance speed of the first conveyance roller pair 208. In this manner, with the provision of a sheet conveyance speed difference, the sheet S passes through the conveyance passage route u in a tensed state between the second conveyance roller pair 209 and the first conveyance roller pair 208 after having nipped by the second conveyance roller pair 209.

In this embodiment, the shutter members 103 are arranged so as not to intersect with a imaginably straight line connecting the nip portion N2 of the second conveyance roller pair 209 and the nip portion N1 of the first conveyance roller pair 208 when being at the skew correction standby positions. Accordingly, in a state in which the sheet S passes through the conveyance passage route u in the tensed state, the shutter members 103 and the sheet S are separated.

Figure 7A:
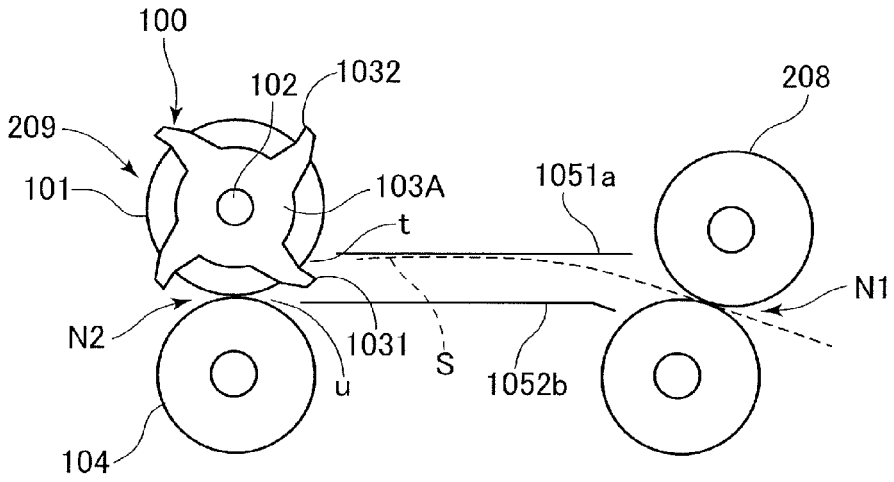
FIG. 7A is a side view illustrating a state in which the sheet is conveyed toward the shutter member.

Subsequently, the skew correcting operation of the skew correcting portion 100 configured in this manner will be described. FIG. 7A is a drawing illustrating the state before the front end of the sheet S reaches the skew correcting portion 100, that is, the state before the sheet S comes into abutment with the protruding portions 1031 of the shutter members 103. At this time, the shutter member 103A is positioned at the skew correction standby positions.

Figure 7B:
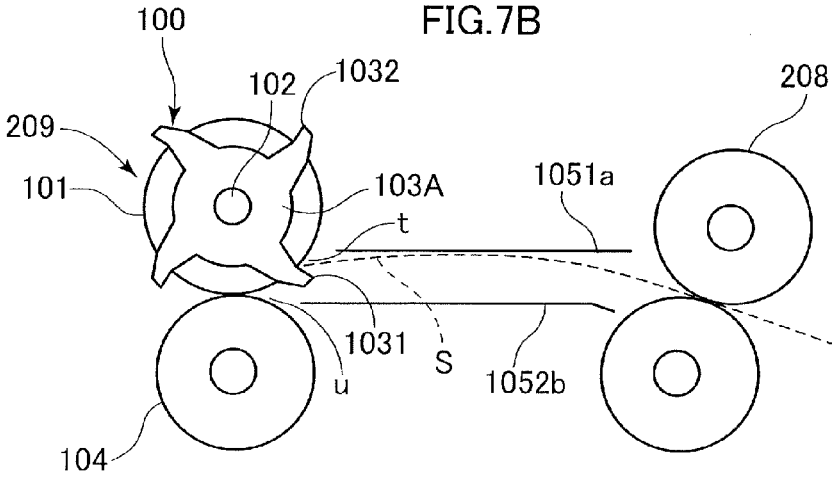
FIG. 7B is a side view illustrating a state in which the sheet abuts against the shutter member.
Figure 7C:
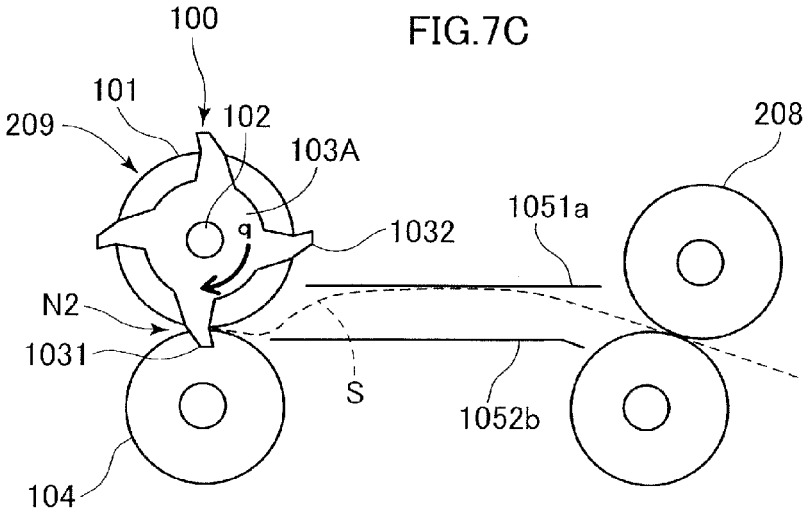
FIG. 7C is a side view illustrating a state in which a loop of the sheet is formed by the sheet being pushed against the shutter member.
Figure 8A:
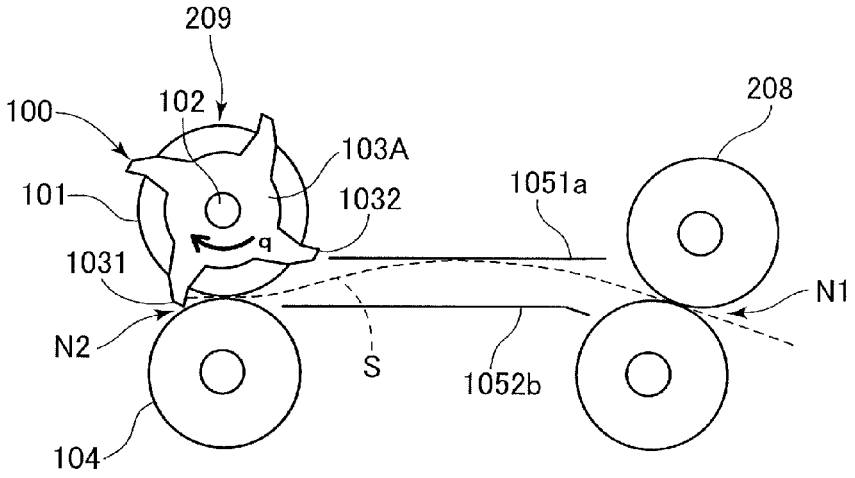
FIG. 8A is a side view illustrating a state in which the shutter member rotates by being pressed by the sheet.

The sheet S conveyed to the first conveyance roller pair 208 by the sheet feed roller 206 and conveyed along the first conveyance guide 1051*a* by the first conveyance roller pair 208 finally reaches the front end passing position t as illustrated in FIG. 7B. At this time, if the sheet S is skewed, the correction of the skew is performed in the same manner as in the first embodiment described already. The sheet S whereof the skew is corrected as illustrated in FIG. 7C enters the nip portion N2 of the second conveyance roller pair 209 as illustrated in FIG. 8A while rotating the shutter member 103A about the shutter shaft 102.

Figure 8B:
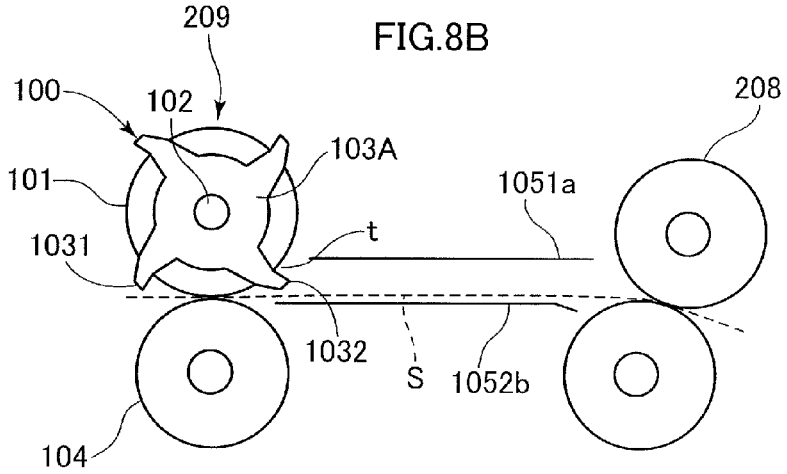
FIG. 8B is a side view illustrating a half-way state when the sheet passes through the shutter member.

At this time, as described already, the sheet conveyance speed of the second conveyance roller pair 209 is set to be higher than the sheet conveyance speed of the first conveyance roller pair 208. Therefore, the sheet S whereof the skew is corrected is conveyed on a substantially imaginably straight line connecting both of the nip portions N1 and N2 between the first conveyance roller pair 208 and the second conveyance roller pair 209 while maintaining the tensed state. Accordingly, the conveyance route of the sheet S is moved from the route along the first conveyance guide 1051*a* up to the front end passing position t to the conveyance passage route u, which is on the nip line of the second conveyance roller pair 209 as illustrated in FIG. 8B. At this time, the shutter member 103A continuously rotates with the pressure exerted by the front end of the sheet S. When the conveyance of the sheet S is further advanced and the shutter member 103A rotates by the predetermined angle or more, the shutter member 103A is rotated until the next protruding portion 1032 reaches the skew correction standby positions, and then are stopped by the cam member 103. Accordingly, the correction of the skew of the following sheet S2 of the shutter member 103A is ready to be started. In this manner, when the front end of the sheet S is conveyed to the nip portion N2 of the second conveyance roller pair 209, the shutter member 103A is moved to the skew correction standby position by the conveyance speed difference between the second conveyance roller pair 209 and the first conveyance roller pair 208, and the cam member.

Figure 8C:
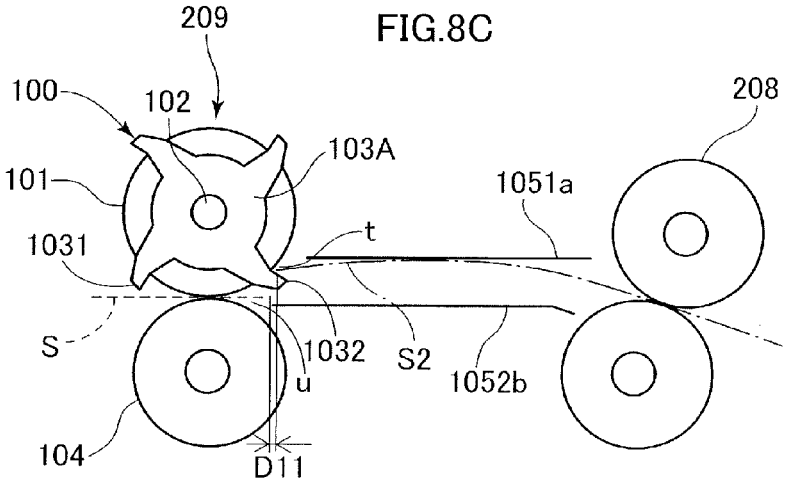
FIG. 8C is a side view illustrating a state in which a rear end of the sheet passes through the shutter member.

The following sheet S2, having already started to be fed during the conveyance of the sheet S, passes through the first conveyance roller pair 208, and is conveyed along the first conveyance guide 1051*a*. As illustrated in FIG. 8C, the following sheet S2 comes into abutment with the protruding portion 1032 of the shutter member 103A positioned at the skew correction standby position at the front end passing position t. When the conveyance is continued, the correction of the skew of the following sheet S2 is started in the same manner as the sheet S.

At this time, since the shutter member 103A is positioned at the skew correction standby position and vibration and the like are over before the front end of the following sheet S2 reaches the protruding portion 1032, the state in which start of the correction of the skew of the following sheet is allowed is achieved. Accordingly, the skew of the following sheet S2 may be corrected irrespective of the position of the rear end of the preceding sheet S. Consequently, the distance D11 between the rear end of the preceding sheet S and the front end of the sheet S2 may be caused to approach 0.

As described above, in this embodiment, the sheet conveyance speed of the second conveyance roller pair 209 is set to be higher than the sheet conveyance speed of the first conveyance roller pair 208. Also, each of the shutter members 103 is arranged such that the protruding portion at the skew correction standby position does not intersect with the imaginably straight line connecting the nip portion N2 of the second conveyance roller pair 209 and the nip portion N1 of the first conveyance roller pair 208. That is, the first and second conveyance roller pairs 208 and 209 are arranged such that an imaginary straight line connecting a nip portion N1 of the first conveyance roller pair 208 and the nip portion N2 of the second conveyance roller pair 209 does not intersect with the protruding portion (abutment portion) of the shutter member 103A in the abutment state.

Accordingly, the sheet S moves away from the shutter member 103A moved to the passing position when the sheet S passes through the conveyance passage route u in the tensed state after having nipped by the second conveyance roller pair 209, whereby the shutter member 103A is moved to the skew correction standby positions. By configuring the shutter member 103 moved to the passing position to move to the skew correction standby position during a period from the passage of the front end of the sheet until leaving of the rear end in this manner, the skew of the following sheet can be corrected before the rear end of the sheet leaves the skew correcting portion 100. Accordingly, the same effects and advantages as in the first embodiment described already are achieved.

Figure 9:
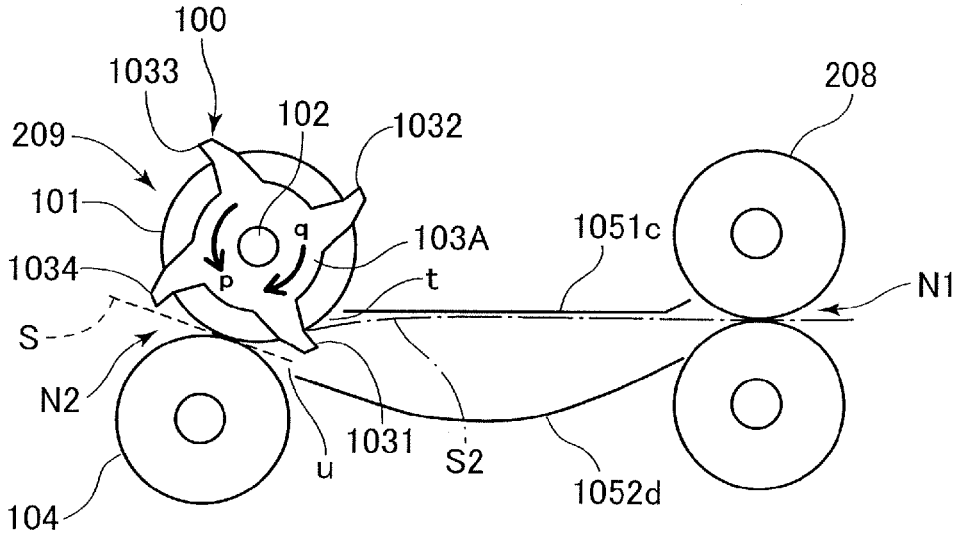
FIG. 9 is a drawing illustrating a configuration of a sheet conveying apparatus of a third embodiment.

Subsequently, a third embodiment of this disclosure will be described. FIG. 9 is a drawing illustrating a configuration of the sheet conveying apparatus of this embodiment. In FIG. 9, the same reference signs as in FIG. 6 described already indicate the same or equivalent portions.

In FIG. 9, reference signs 1051*c* and 1052*d* denote first and second conveyance guides provided between the first conveyance roller pair 208 and the second conveyance roller pair 209 so as to face each other, and configuring part of the sheet conveying path R. The first conveyance guide 1051*c* has a straight shape, and the second conveyance guide 1052*d*, which is an opposed guide portion provided so as to oppose the first conveyance guide 1051*c*, has a curved shape protruding outward.

In this embodiment, the direction of the nip line of the first conveyance roller pair 208 extends in parallel to the first conveyance guide 1051*c*. Also, the first conveyance roller pair 208 is arranged such that the nip line of the first rotator pair 208 intersects with the protruding portion of the shutter member 103 in the abutment state when viewed from a direction of a rotation axis of the second conveyance roller pair 209. Unlike the direction of the nip line of the first conveyance roller pair 208, the direction of the nip line of the second conveyance roller pair 209 is parallel to a downstream side portion of the conveyance guide 1052*d* in the sheet conveying direction. In other words, the second conveyance roller pair 209 is configured such that the nip line of the second conveyance roller pair 209 is inclined in a direction approaching to the side of the driven roller 101 from the side of the driving roller 104 as the nip line advances upstream to downstream in the sheet conveying direction when viewed from a direction of a rotation axis of the second conveyance roller pair 209.

In addition, in this embodiment, the sheet conveyance speed of the second conveyance roller pair 209 is set to be lower than the sheet conveyance speed of the first conveyance roller pair 208. In this manner, with the provision of a sheet conveyance speed difference, the sheet S passes through the conveyance passage route u while deflecting toward the second conveyance guide 1052*d* between the second conveyance roller pair 209 and the first conveyance roller pair 208 after having nipped by the second conveyance roller pair 209. Accordingly, when the sheet S passes through the conveyance passage route u, the shutter members 103 and the sheet S are separated.

Figure 10A:
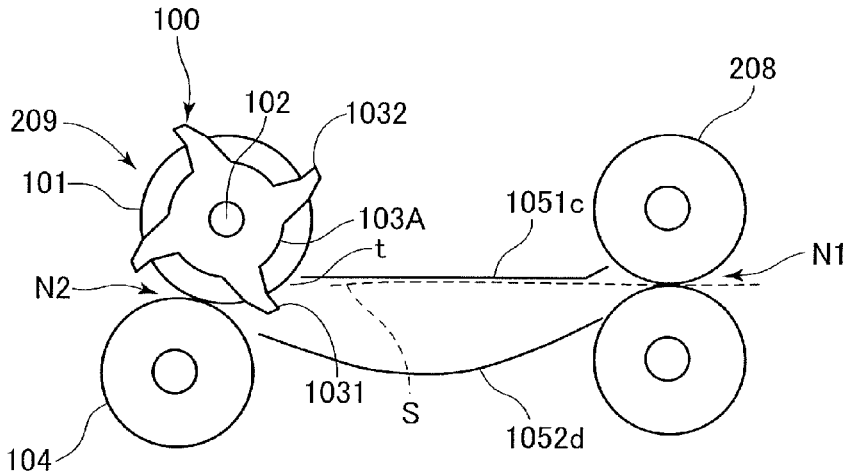
FIG. 10A is a side view illustrating a state in which the sheet is conveyed toward the shutter member.

Subsequently, the skew correcting operation of the skew correcting portion 100 configured as described above will be described. FIG. 10A is a drawing illustrating the state before the front end of the sheet S reaches the skew correcting portion 100, that is, the state before the sheet S comes into abutment with the protruding portion 1031 of the shutter member 103A. At this time, the shutter member 103A is positioned at the skew correction standby position.

Figure 10B:
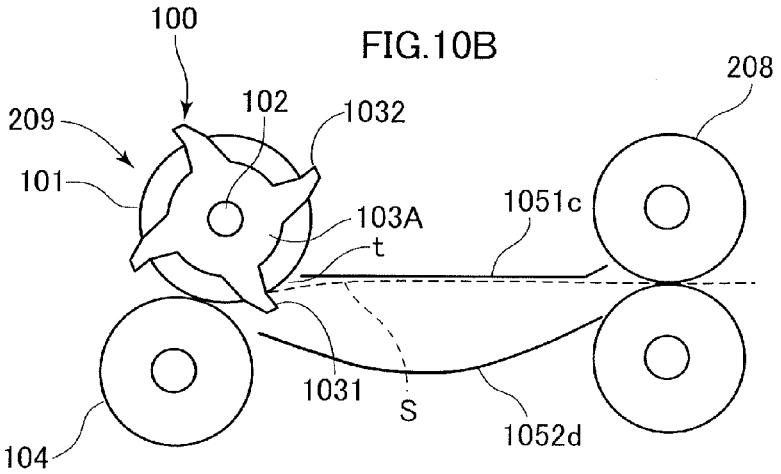
FIG. 10B is a side view illustrating a state in which the sheet abuts against the shutter member.
Figure 10C:
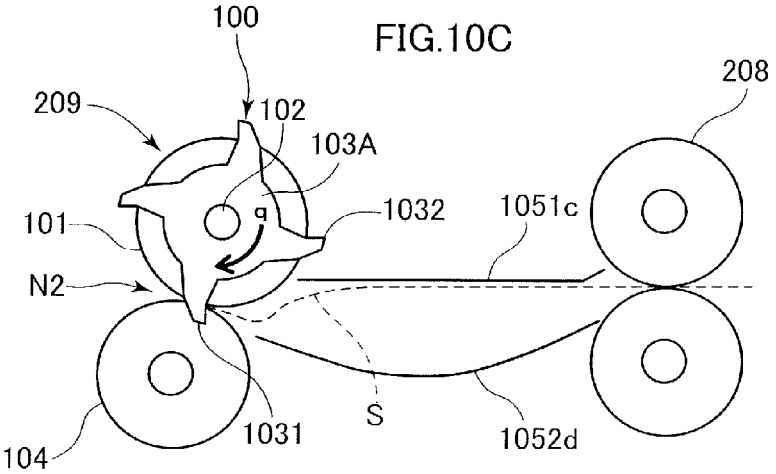
FIG. 10C is a side view illustrating a state in which a loop of the sheet is formed by the sheet being pushed against the shutter member.

The sheet S conveyed to the first conveyance roller pair 208 by the sheet feed roller 206 and conveyed along the first conveyance guide 1051*c* by the first conveyance roller pair 208 finally reaches the front end passing position t as illustrated in FIG. 10B. At this time, if the sheet S is skewed, the correction of the skew is performed in the same manner as in the first embodiment described already. The sheet S whereof the skew is corrected then enters into the nip portion N2 of the second conveyance roller pair 209 as illustrated in FIG. 10C while rotating the shutter member 103A about the shutter shaft 102.

Figure 11A:
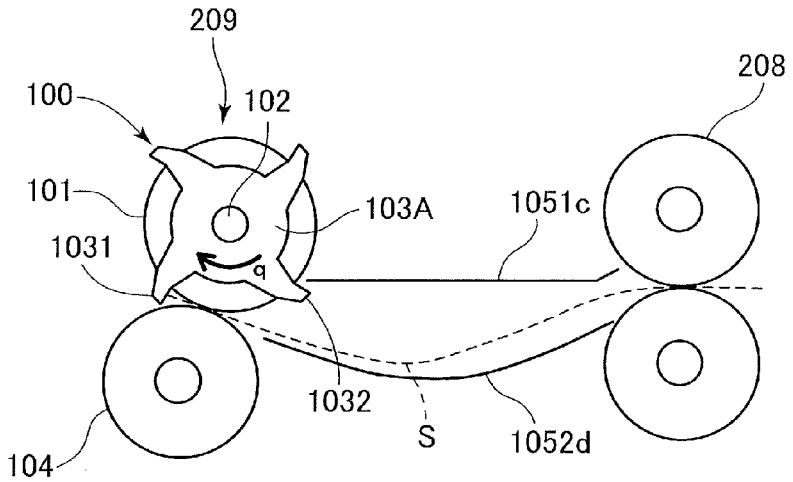
FIG. 11A is a side view illustrating a state in which the shutter member rotates by being pressed by the sheet.
Figure 11B:
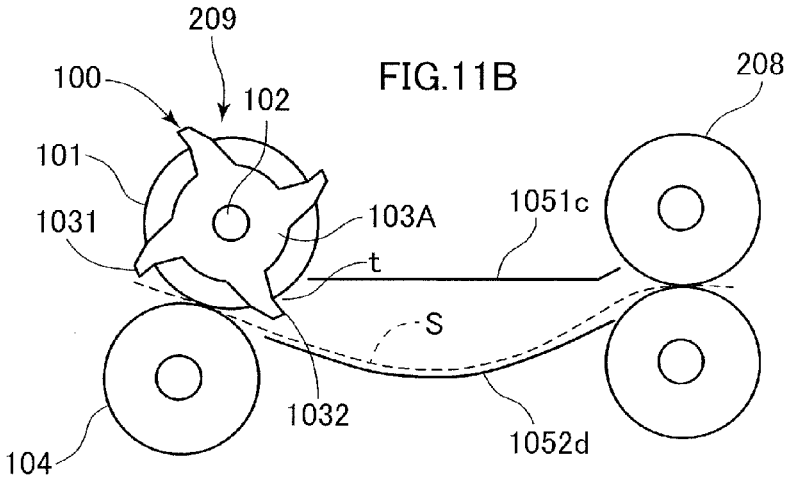
FIG. 11B is a side view illustrating a half-way state when the sheet passes through the shutter member.

Subsequently, the sheet S passes through the nip portion N2 in the state of being nipped by the second conveyance roller pair 209. At this time, the conveyance speed of the second conveyance roller pair 209 is set to be lower than the conveyance speed of the first conveyance roller pair 208 as described already. Therefore, the sheet S is conveyed while being deflected toward the second conveyance guide 1052*d* between the first conveyance roller pair 208 and the second conveyance roller pair 209 as illustrated in FIG. 11A. Accordingly, the conveyance route of the sheet S is changed from a route along the first conveyance guide 1051*c* up to the front end passing position t to the conveyance passage route u, which is on the nip line of the second conveyance roller pair 209.

When the conveyance of the sheet S is further advanced and the shutter member 103A rotate by the predetermined angle or more, the shutter member 103A are rotated until the next protruding portion 1032 reaches the skew correction standby positions, and then are stopped by the cam member. Accordingly, correction of the skew of the following sheet S2 by the shutter member 103A is ready to be started. In this manner, when the front end of the sheet S is conveyed to the nip portion N2 of the second conveyance roller pair 209, the shutter member 103A are moved to the skew correction standby position by the conveyance speed difference between the second conveyance roller pair 209 and the first conveyance roller pair 208, and the cam member.

Figure 11C:
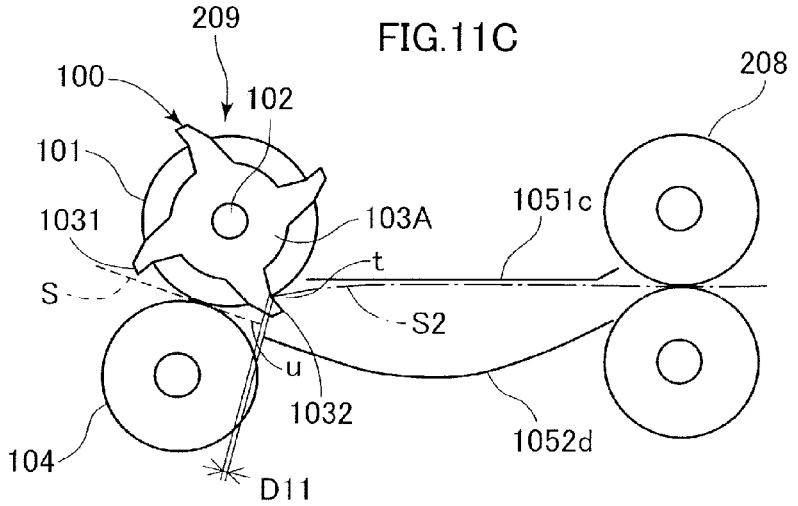
FIG. 11C is a side view illustrating a state in which a rear end of the sheet passes through the shutter member.

The following sheet S2, having already started to be fed during the conveyance of the sheet S, passes through the first conveyance roller pair 208, and is conveyed along the conveyance guide 1051. As illustrated in FIG. 11C, the following sheet S2 comes into abutment with the protruding portion 1032 of the shutter member 103A positioned at the skew correction standby position at the front end passing position t. When the conveyance is further continued, the correction of the skew of the following sheet S2 is started in the same manner as the sheet S.

At this time, since the shutter member 103A is positioned at the skew correction standby positions and vibration and the like are over before the front end of the following sheet S2 reaches the shutter protruding portion 1032, the state in which start of the correction of the skew of the following sheet is allowed is achieved. Accordingly, the skew of the following sheet S2 may be corrected irrespective of the position of the rear end of the preceding sheet S. Consequently, the distance D11 between the rear end of the preceding sheet S and the front end of the sheet S2 may be caused to approach 0.

As described above, in this embodiment, the sheet conveyance speed of the second conveyance roller pair 209 is set to be lower than the sheet conveyance speed of the first conveyance roller pair 208. That is, the second conveyance roller pair 209 is set such that the rotational speed is lower than the rotational speed of the first conveyance roller pair 208 at least when the sheet is nipped and conveyed by both of nip portions N1 and N2 of the first and second conveyance roller pairs 208 and 209. Also, when the protruding portions 1031 to 1034 of the shutter members 103 are at the skew correction standby positions, the protruding portions 1031 to 1034 of the shutter members 103 are arranged so as not to intersect with a imaginably straight line connecting the nip portion N2 of the second conveyance roller pair 209 and the nip portion N1 of the first conveyance roller pair 208.

In this manner, with the provision of a sheet conveyance speed difference, the sheet S is nipped by the second conveyance roller pair 209, then the sheet S moves away from the shutter members 103 and the shutter members 103 move to the skew correction standby position when the sheet S passes through the conveyance passage route u while deflecting toward the second conveyance guide 1052*d*. By configuring the shutter members 103 moved to the passing position to move to the skew correction standby position during a period from the passage of the front end of the sheet until leaving of the rear end in this manner, the skew of the following sheet can be corrected before the rear end of the sheet leaves the skew correcting portion 100. Accordingly, the same effects and advantages as in the first embodiment described already are achieved.

Figure 12:
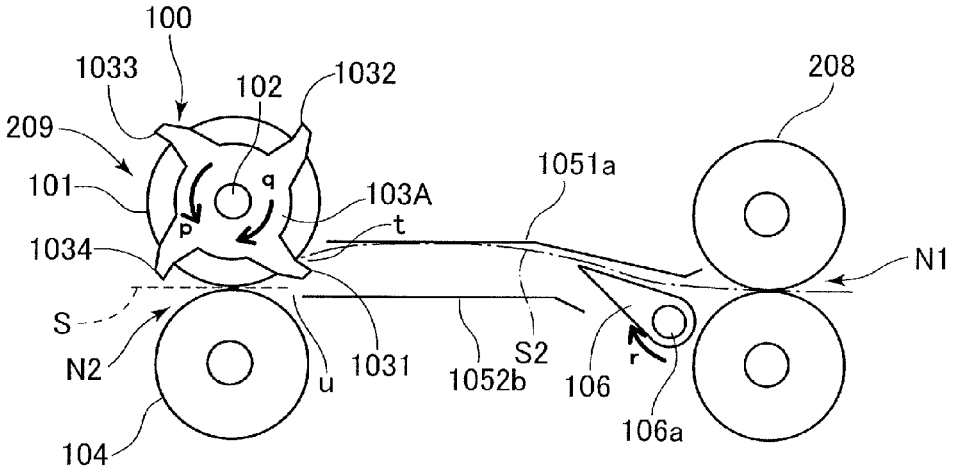
FIG. 12 is a drawing illustrating a configuration of a sheet conveying apparatus of a fourth embodiment.

Subsequently, a fourth embodiment of this disclosure will be described. FIG. 12 is a drawing illustrating a configuration of the sheet conveying apparatus of this embodiment. In FIG. 12, the same reference signs as in FIG. 6 described already indicate the same or equivalent portions.

In FIG. 12, reference numeral 106 denotes a guide member, which is a sheet conveying direction regulation member provided so as to be pivotable about a shaft 106*a* on the downstream side of the first conveyance roller pair 208 in the sheet conveying direction, and direct the sheet conveyed by the first conveyance roller pair 208 toward the first conveyance guide 1051*a*. The guide member 106 is biased toward a direction indicated by an arrow r to bring the conveyed sheet into contact with the first conveyance guide 1051*a* by a biasing spring, not illustrated. In addition, in this embodiment, the sheet conveyance speed of the second conveyance roller pair 209 is set to be higher than the sheet conveyance speed of the first conveyance roller pair 208. In this manner, with the provision of a sheet conveyance speed difference, the sheet S passes through the conveyance passage route u in the tensed state between the second conveyance roller pair 209 and the first conveyance roller pair 208 after having nipped by the second conveyance roller pair 209.

Here, the sheet S passed through the first conveyance roller pair 208 is guided in the direction to come into contact with the first conveyance guide 1051*a* by the guide member 106 until the sheet S is nipped by the second conveyance roller pair 209. The sheet S after having come into contact with the first conveyance guide 1051*a* moves along the first conveyance guide 1051*a*, and finally comes into abutment with the protruding portions 1031 of the shutter members 103. When the conveyance of the sheet S is advanced and the sheet S is conveyed between the second conveyance roller pair 209 and the first conveyance roller pair 208 in the tensed state, the guide member 106 is pressed by the sheet S in the tensed state, and pivots in the direction opposite from an arrow r against the biasing spring. That is, the guide member (sheet conveying direction regulation member) 106 is provided downstream, in the sheet conveying direction, of the first rotator pair and capable of moving to a first position from which the sheet is guided toward a first conveyance guide 1052*a* side and to a second position moved toward the second conveyance guide 1052*b* side from the first position. Also, the first and second conveyance roller pairs are arranged such that an imaginary straight line connecting a nip portion N1 of the first conveyance roller pair 208 and the nip portion N2 of the second conveyance roller pair 209 does not intersect with the protruding portions 1031 to 1034 of the shutter member 103 in the abutment state. Therefore, the guide member 106 is configured to move from the first position to the second position by being pressed by the sheet which is nipped and conveyed by the both of the first and second nip portions 208 and 209 of the first and second conveyance roller pairs 208 and 209.

Figure 13A:
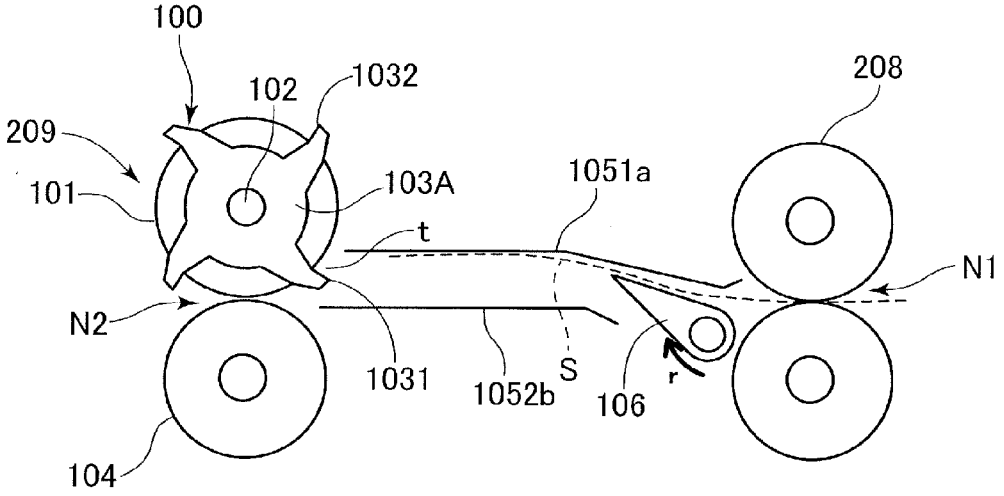
FIG. 13A is a side view illustrating a state in which the sheet is conveyed toward the shutter member.

Subsequently, the skew correcting operation of the skew correcting portion 100 configured in this manner will be described. FIG. 13A is a drawing illustrating the state before the front end of the sheet S reaches the skew correcting portion 100, that is, the state before the sheet comes into abutment with the protruding portion 1031 of the shutter member 103A. At this time, the shutter member 103A is positioned at the skew correction standby positions, and the guide member 106 is moved toward the first conveyance guide 1051*a*.

Figure 13B:
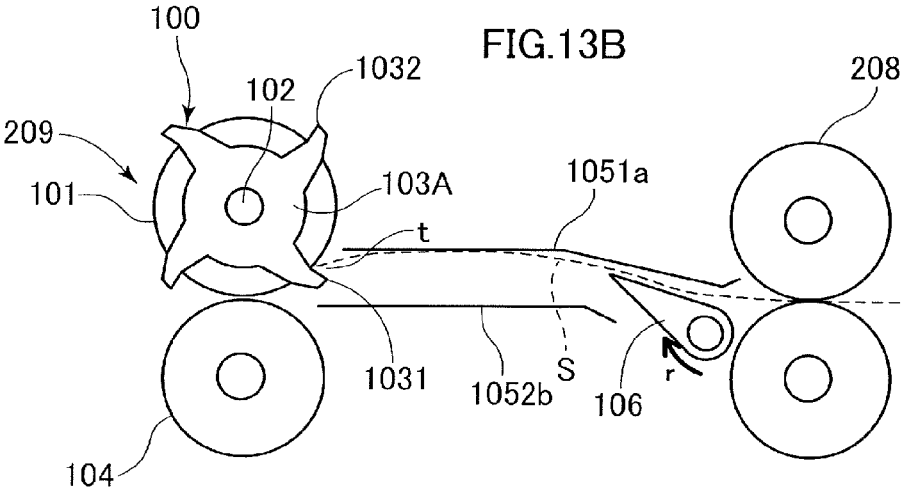
FIG. 13B is a side view illustrating a state in which the sheet is conveyed toward the shutter member.
Figure 13C:
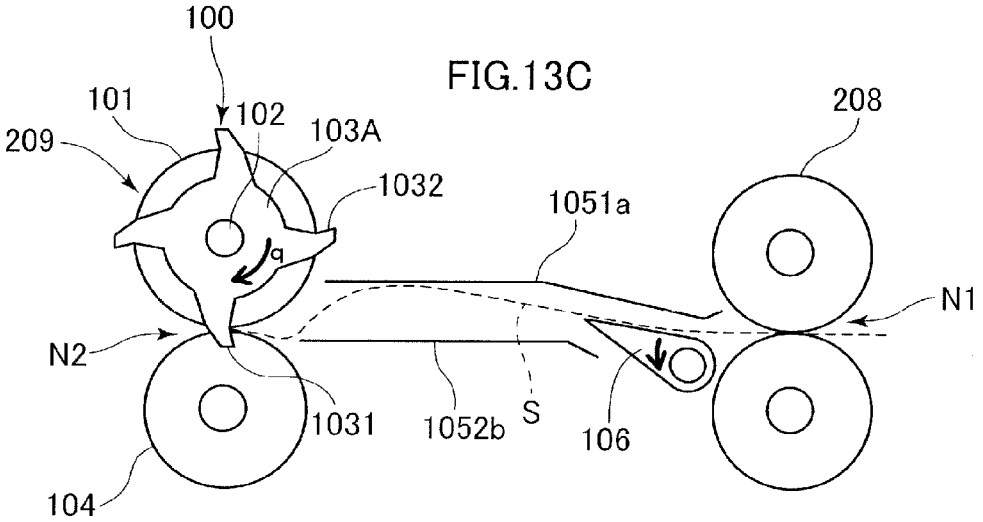
FIG. 13C is a side view illustrating a state in which a loop of the sheet is formed by the sheet being pushed against the shutter member.

The sheet S conveyed to the first conveyance roller pair 208 by the sheet feed roller 206 and guided along the first conveyance guide 1051*a* by the guide member 106 finally reaches the front end passing position t as illustrated in FIG. 13B. At this time, if the sheet S is skewed, the correction of the skew is performed in the same manner as in the first embodiment described already. The sheet S whereof the skew is corrected then enters into the nip portion N2 of the second conveyance roller pair 209 as illustrated in FIG. 13C while rotating the shutter member 103A about the shutter shaft 102. Subsequently, the sheet S passes through the nip portion N2 in the state of being nipped by the second conveyance roller pair 209.

Figure 14A:
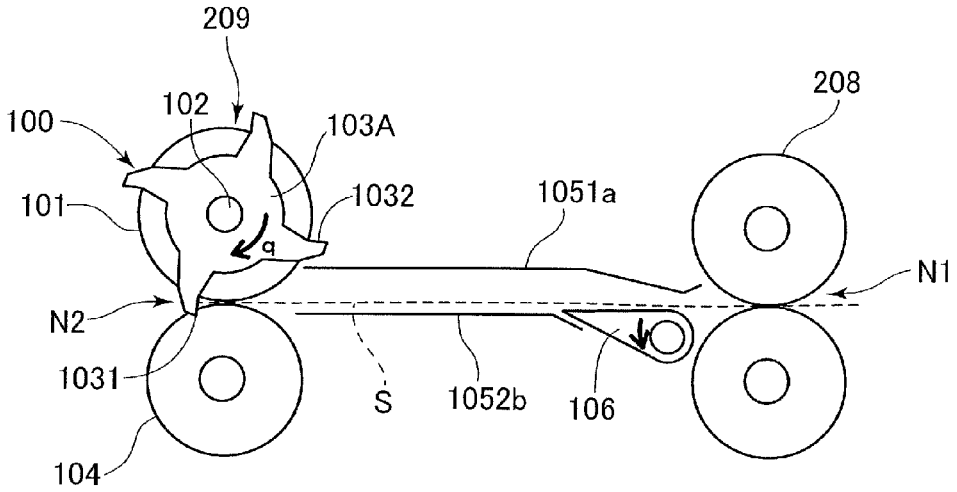
FIG. 14A is a side view illustrating a state in which the shutter member rotates by being pressed by the sheet.

At this time, as described already, the sheet conveyance speed of the second conveyance roller pair 209 is set to be higher than the conveyance speed of the first conveyance roller pair 208. In other words, the second conveyance roller pair 209 is set such that a rotational speed is higher than a rotational speed of the first conveyance roller pair 208 at least when the sheet is nipped and conveyed by both of the nip portions N1 and N2 of the first and second conveyance roller pairs 208 and 209. Therefore, the sheet S is conveyed on a substantially imaginably straight line connecting both of the nip portions N1 and N2 between the first conveyance roller pair 208 and the second conveyance roller pair 209 while maintaining the tensed state. Accordingly, the conveyance route of the sheet S is moved from a route along the first conveyance guide 1051*a* up to the front end passing position t to the conveyance passage route u which is on the nip line of the second conveyance roller pair 209 as illustrated in FIG. 14A. At this time, the guide member 106 pivots toward the second conveyance guide 1051*b* side against the biasing spring, and the shutter member 103A rotates continuously by a pressure receiving from the front end of the sheet S.

Figure 14B:
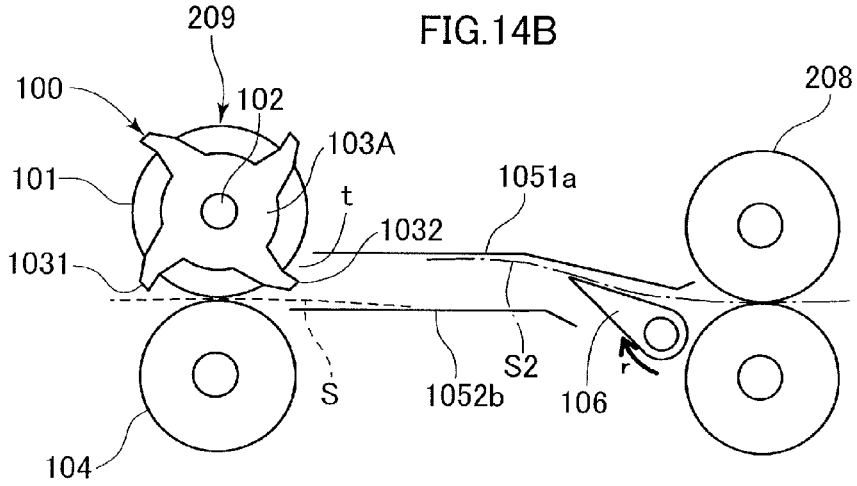
FIG. 14B is a side view illustrating a half-way state when the sheet passes through the shutter member.

When the conveyance passage route is moved, the sheet S moves in the direction away from the protruding portion 1031 of the shutter member 103A as illustrated in FIG. 14B. When the conveyance of the sheet S is further advanced and the shutter member 103A rotates by the predetermined angle or more, the shutter member 103A is rotated until the next protruding portion 1032 reaches the skew correction standby positions, and then are stopped by the cam member. Accordingly, the correction of the skew of the following sheet S2 of the shutter member 103A is ready to be started.

Figure 14C:
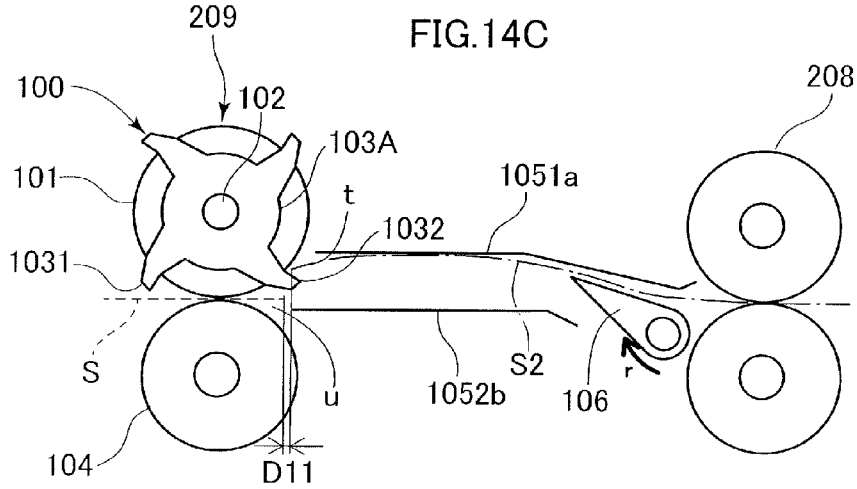
FIG. 14C is a side view illustrating a state in which a rear end of the sheet passes through the shutter member.

In this manner, when the front end of the sheet S is conveyed to the nip portion N2 of the second conveyance roller pair 209, the shutter member 103A is moved to the skew correction standby position by the conveyance speed difference between the second conveyance roller pair 209 and the first conveyance roller pair 208, and the cam member. The following sheet S2, having already started to be fed during the conveyance of the sheet S, passes through the first conveyance roller pair 208, and is conveyed along the conveyance guide 1051. As illustrated in FIG. 14C, the following sheet S2 comes into abutment with the protruding portion 1032 of the shutter member 103A positioned at the skew correction standby position at the front end passing position t. When the conveyance is continued, the correction of the skew of the following sheet S2 is started in the same manner as the sheet S.

At this time, the shutter member 103A is positioned at the skew correction standby position and vibration and the like is over before the front end of the following sheet S2 reaches the protruding portions 1032, the state in which start of the correction of the skew of the following sheet is allowed is achieved. Consequently, the distance D11 between the rear end of the preceding sheet S and the front end of the sheet S2 may be caused to approach 0.

As described above, in this embodiment, the sheet conveyance speed of the second conveyance roller pair 209 is set to be higher than the sheet conveyance speed of the first conveyance roller pair 208. The guide member 106 is configured to pivot toward the second conveyance guide 1051*b* by being pressed by the sheet when the sheet is moved away from the shutter members 103.

Accordingly, the sheet S moves away from the shutter members 103 moved to the passing position when the sheet S passes through the conveyance passage route u in the tensed state after having nipped by the second conveyance roller pair 209, whereby the shutter members 103 are moved to the skew correction standby positions. By configuring the shutter members 103 in the passing position to move to the skew correction standby position during a period from the passage of the front end of the sheet until leaving of the rear end in this manner, the skew of the following sheet can be corrected before the rear end of the sheet moves the skew correcting portion 100. Accordingly, the same effects and advantages as in the first embodiment described already are achieved.

So far, the case where the shutter members 103 provided with the plurality of protruding portions and configured to rotate to the contact position after one of the protruding portions is moved to the passing position so as to bring other protruding portions to come into contact with the sheet conveyed subsequently by being pressed by the sheet are used as the shutter members has been described. However, this disclosure is not limited thereto, and a shutter member having one protruding portion and configured to reciprocate between the passing position and the skew correction standby position may be used as the shutter member.

Figure 15:
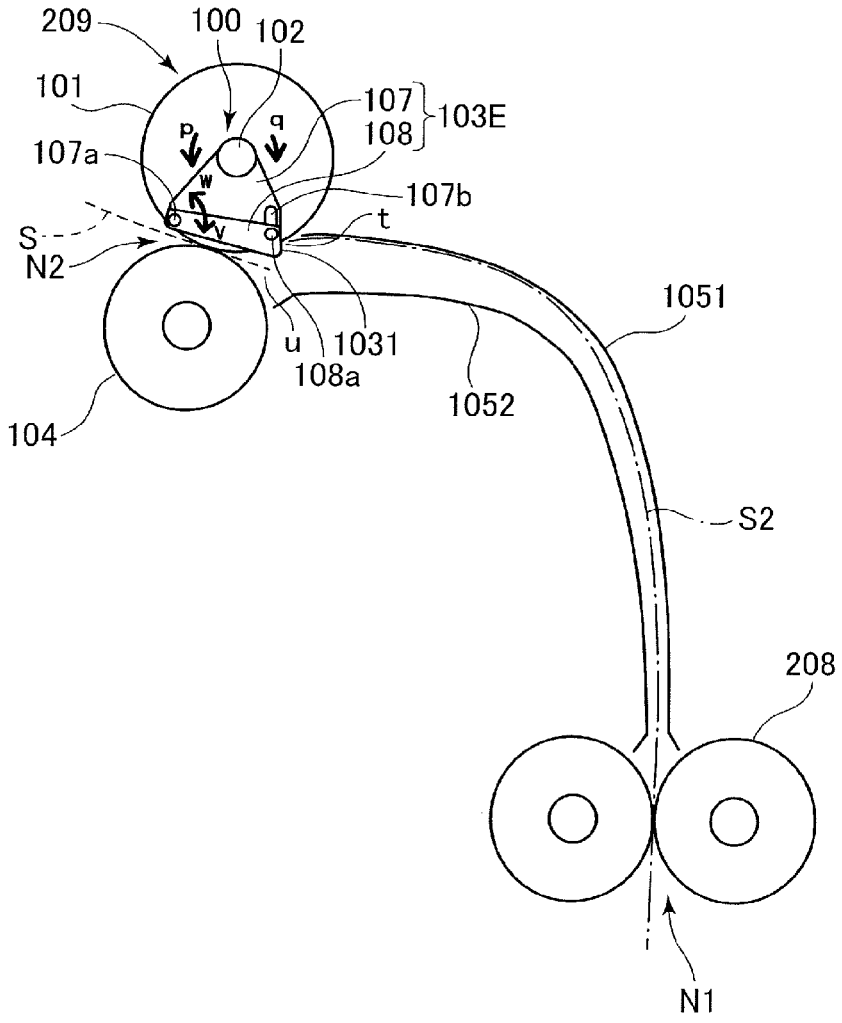
FIG. 15 is a drawing illustrating a configuration of a sheet conveying apparatus of a fifth embodiment.

A fifth embodiment of this disclosure will be described below. FIG. 15 is a drawing illustrating the configuration of the sheet conveying apparatus of this embodiment. In FIG. 15, the same reference signs as in FIG. 2 as described already indicate the same or equivalent portions. In FIG. 15, reference numeral 103E denotes a shutter member, and a plurality of the shutter members 103E are fixed onto the shutter shaft 102 at the same phase and are supported so as to be rotatable with respect to the conveyance frame, which is not illustrated.

The shutter member 103E is provided with a base member 107 and a pivot member 108. The base member 107 pivots about the shutter shaft 102, the pivot member 108 pivots about a shutter shaft 107*a* provided on the base member 107, and is provided with a pin 108*a* to be engaged to a groove portion 107*b* provided on the base member 107 at the pivot end. The front end of the pivot member 108 is provided with the protruding portion 1031 configured to stop the front end of the sheet S once by contact therewith for correcting the skew at a front end thereof. In this embodiment, the shutter member 103E is arranged so that the protruding portion 1031 comes into abutment with the sheet conveyed along the conveyance guide 1051, and is positioned above the nip line of the second conveyance roller pair 209.

The shutter member 103E is subjected to the biasing force of a torsion coil spring, which is not illustrated, in the direction p, and stops at the skew correction standby position by a stopper member, which is not illustrated. The sheet S comes into abutment with the protruding portion 1031 and, when the protruding portion 1031 is pressed by the sheet S in contact by a predetermined pressure or higher, the shutter member 103E pivots in the direction q about the shutter shaft 102.

Figure 16A:
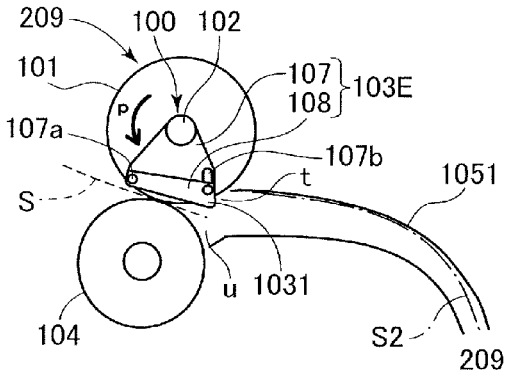
FIG. 16A is a side view illustrating a state in which the sheet is conveyed toward the shutter member.
Figure 16B:
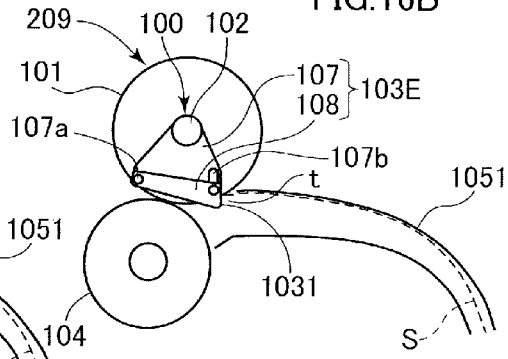
FIG. 16B is a side view illustrating a state in which the sheet abuts against the shutter member.
Figure 16C:
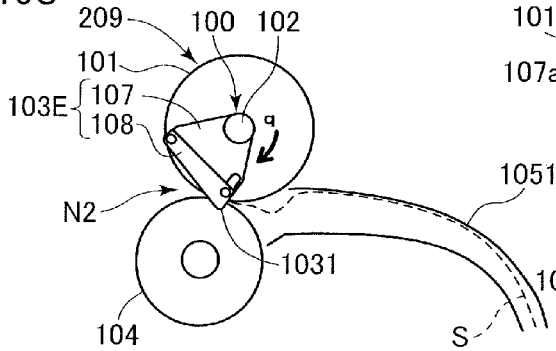
FIG. 16C is a side view illustrating a state in which a loop of the sheet is formed by the sheet being pushed against the shutter member.
Figure 16D:
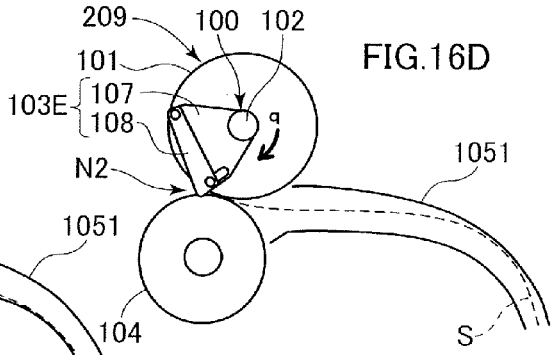
FIG. 16D is a side view illustrating a state in which the shutter member rotates by being pressed by the sheet.
Figure 16E:
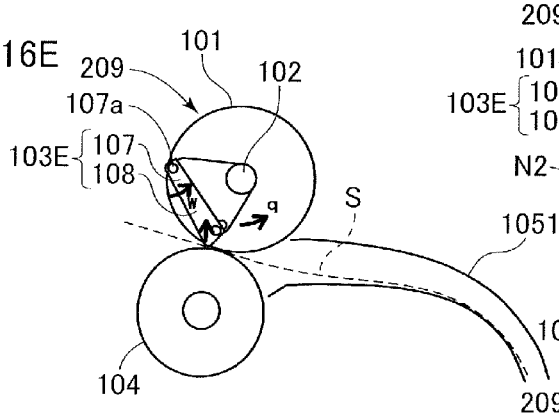
FIG. 16E is a side view illustrating a half-way state when the sheet passes through the shutter member.

When the shutter member 103E pivots by a predetermined angle or more, the pivot member 108 is pushed upward by the sheet S as illustrated in FIG. 16E, described later, and is pivoted about the shutter shaft 107*a* in a direction W. In association with this, the base member 107 pivots in the direction q to move to the skew correction position.

Subsequently, the skew correcting operation of the skew correcting portion 100 configured in this manner will be described. FIG. 16A is a drawing illustrating the state before the front end of the sheet S reaches the skew correcting portion 100, that is, the state before the sheet comes into abutment with the protruding portions 1031 of the shutter members 103E. The sheet S conveyed to the first conveyance roller pair 208 by the sheet feed roller 206 and guided along the conveyance guide 1051 finally reaches the front end passing position t as illustrated in FIG. 16B. At this time, if the sheet S is skewed, the correction of the skew is performed in the same manner as in the first embodiment described already. The sheet S whereof the skew is corrected enters into the nip portion N2 of the second conveyance roller pair 209 as illustrated in FIG. 16D while rotating the shutter members 103E about the shutter shaft 102 as illustrated in FIG. 16C. Subsequently, the sheet S passes through the nip portion N2 in the state of being nipped by the second conveyance roller pair 209. In this case, the conveyance route of the sheet S is moved from the route along the conveyance guide 1051 up to the front end passing position t to the conveyance passage route u, which is on the nip line of the second conveyance roller pair 209. The shutter members 103 at this time continuously rotate with a pressure exerted by the front end of the sheet S.

When the conveyance of the sheet S is further advanced and the shutter member 103E pivots by a predetermined angle or more, the pivot member 108 is pushed upward by the sheet S as illustrated in FIG. 16E, and is pivoted about the shutter shaft 107*a* in a direction W. By the pivot member 108 pivoting in the direction W in this manner and a front end portion thereof moving toward the center of the shutter shaft 102, the pressure exerted by the sheet is reduced. Accordingly, the base member 107 pivots in the direction q about the shutter shaft 102, moves to the skew correction standby position, and the shutter members 103 become ready for starting the skew correction of the front end of the following sheet S2.

Figure 16F:
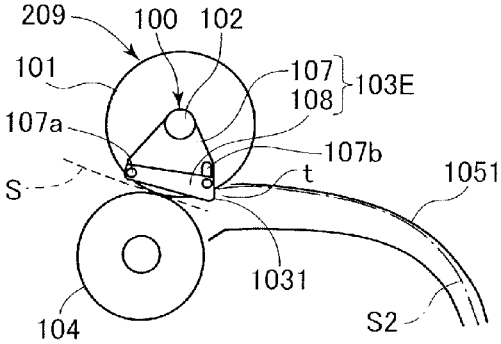
FIG. 16F is a side view illustrating a state in which a rear end of the sheet passes through the shutter member.

The following sheet S2, having already started to be fed during the conveyance of the sheet S, passes through the first conveyance roller pair 208, and is conveyed along the conveyance guide 1051. As illustrated in FIG. 16F, the following sheet S2 comes into abutment with the pivot member 108 of the shutter member 103E positioned at the skew correction standby position at the front end passing position t. When the conveyance is continued, the correction of the skew of the following sheet S2 is started in the same manner as the sheet S.

At this time, since the shutter members 103E are positioned at the skew correction standby positions and vibration and the like are over before the front end of the following sheet S2 reaches the pivot member 108, the state in which start of the correction of the skew of the following sheet is allowed is achieved. Accordingly, the skew of the following sheet S2 may be corrected irrespective of the position of the rear end of the preceding sheet S. Consequently, the distance between the rear end of the preceding sheet S and the front end of the sheet S2 may be caused to approach 0.

That is, is the shutter member 103E is configured to reciprocate between an abutment position where the abutment portion, the protruding portions 1031 in this embodiment, protrudes into the sheet conveying path R at upstream of the nip portion N2 of the second conveyance roller pair 209 in the sheet conveying direction and a retracted position where the abutment portion 1031 retracts from the sheet conveying path R by being pressed by the sheet S.

As described thus far, in this embodiment, the sheet is moved away from the shutter member 103E before the rear end of the sheet passes through the shutter member 103E to move the shutter member 103E to the skew correction standby position. Accordingly, even though the sheet conveyance speed is high, the skew of the sheet may be corrected at the short inter-sheet distance. In other words, even when the shutter member 103E having one protruding portion 1031 is used, the same effects and advantages as the first embodiment described already may be achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-076750, filed Apr. 3, 2014, which is hereby incorporated by reference herein in its entirety.

What is claimed is:

1. A sheet conveying apparatus comprising:

a first rotator pair configured to convey a sheet;

a second rotator pair provided downstream, in a sheet conveying direction, of the first rotator pair; and a rotating member including;

a first protruding portion against which a front end of a first sheet conveyed from the first rotator pair abuts in a state in which the rotating member stops at a first abutment position where the first protruding portion protrudes into a sheet conveying path upstream, in the sheet conveying direction, of a nip portion of the second rotator pair; and a second protruding portion against which a front end of a second sheet conveyed from the first rotator pair in succession to the first sheet abuts in a state in which the rotating member stops at a second abutment position where the second protruding portion protrudes into the sheet conveying path upstream, in the sheet conveying direction, of the nip portion of the second rotator pair, the rotating member being configured to turn in a predetermined direction from the first abutment position to the second abutment position through a passage state in which the first sheet is allowed to pass the first protruding portion, if the first protruding portion is pushed by the first sheet, wherein the rotating member is configured to turn to a standby position and standby at the second abutment position before a rear end of the first sheet reaches to the nip portion of the second rotator pair, and wherein the second rotator pair is arranged such that a nip line, which is a tangent line of the nip portion, of the second rotator pair does not intersect with the first protruding portion at the first abutment position and the second protruding portion at the second abutment position when viewed from a direction of a rotation axis of the second rotator pair.

2. The sheet conveying apparatus according to claim 1, wherein the second rotator pair includes a first rotator provided on the same side with the rotating member with respect to the nip portion, and a second rotator disposed opposite to the first rotator.

3. The sheet conveying apparatus according to claim 1, wherein the second rotator pair is set such that a rotational speed is higher than a rotational speed of the first rotator pair at least when the sheet is nipped and conveyed by both of the nip portions of the first and second rotator pairs.

4. The sheet conveying apparatus according to claim 1, wherein the second rotator pair is set such that the rotational speed is lower than the rotational speed of the first rotator pair at least when the sheet is nipped and conveyed by both of nip portions of the first and second rotator pairs.

5. The sheet conveying apparatus according to claim 4, wherein the second rotator pair includes a first rotator provided on the same side with the rotating member with respect to the nip portion of the second rotator pair and a second rotator disposed opposite to the first rotator, and wherein a nip line, which is a tangent line at the nip portion, of the second rotator pair is inclined in a direction approaching to the first rotator side from the second rotator side as the nip line advances upstream to downstream in the sheet conveying direction when viewed from a direction of a rotation axis of the second rotator pair.

6. The sheet conveying apparatus according to claim 4, wherein the first rotator pair is arranged such that a nip line, which is a tangent line of the nip portion, of the first rotator pair intersects with the first protruding portion at the first abutment position and the second protruding portion at the second abutment position when viewed from a direction of a rotation axis of the second rotator pair.

7. The sheet conveying apparatus according to claim 4, further comprising a guide portion forming the sheet conveying path between the first and second rotator pairs and including a first conveyance guide guiding the sheet on a side of the rotating member of the sheet conveying path and a second conveyance guide provided to face the first conveyance guide, wherein the second conveyance guide is curvedly formed in a direction away from the first conveyance guide.

8. The sheet conveying apparatus according to claim 1, further comprising:

a guide portion forming the sheet conveying path between the first and second rotator pairs and including a first conveyance guide guiding the sheet on a side of the rotating member of the sheet conveying path and a second conveyance guide provided to face the first conveyance guide; and a sheet conveying direction regulation member provided downstream, in the sheet conveying direction, of the first rotator pair and being capable of moving to a first position from which the sheet is guided toward a first conveyance guide side, and a second position moved toward the second conveyance guide side from the first position.

9. An image forming apparatus comprising:

an image forming portion; and the sheet conveying apparatus according to claim 1 configured to convey a sheet.

10. The sheet conveying apparatus according to claim 1, wherein the second protruding portion is abutted with the front end of the second sheet while the second rotator pair conveying the first sheet.

11. A sheet conveying apparatus comprising:

a first rotator pair configured to convey a sheet;

a second rotator pair provided downstream, in a sheet conveying direction, of the first rotator pair; and a rotating member including:

a first protruding portion against which a front end of a first sheet conveyed from the first rotator pair abuts in a state in which the rotating member stops at a first abutment position where the first protruding portion protrudes into a sheet conveying path upstream, in the sheet conveying direction, of a nip portion of the second rotator pair; and a second protruding portion against which a front end of a second sheet conveyed from the first rotator pair in succession to the first sheet abuts in a state in which the rotating member stop at a second abutment position where the second protruding portion protrudes into the sheet conveying path upstream, in the sheet conveying direction, of the nip portion of the second rotator pair, the rotating member being configured to turn in a predetermined direction from the first abutment position to the second abutment position through a passage state in which the first sheet is allowed to pass the first protruding portion, if the first protruding portion is pushed by the first sheet, wherein the rotating member is configured to turn to a standby position and standby at the second abutment position before a rear end of the first sheet reaches to the nip portion of the second rotator pair, wherein the second rotator pair includes a first rotator provided on the same side with the rotating member with respect to the nip portion of the second rotator pair, and a second rotator disposed opposite to the first rotator, and wherein a nip line, which is a tangent line of the nip portion, of the second rotator pair is inclined in a direction approaching to a side of the first rotator from a side of the second rotator as the nip line advances upstream to downstream in the sheet conveying direction when viewed from a direction of a rotation axis of the second rotator pair.

12. A sheet conveying apparatus comprising:

a first rotator pair configured to convey a sheet;

a second rotator pair provided downstream, in a sheet conveying direction, of the first rotator pair;

a guide portion curvedly forming the sheet conveying path between the first and second rotator pairs; and a rotating member including:

a first protruding portion against which a front end of a first sheet conveyed from the first rotator pair abuts in a state in which the rotating member stops at a first abutment position where the first protruding portion protrudes into a sheet conveying path upstream, in the sheet conveying direction, of a nip portion of the second rotator pair; and a second protruding portion against which a front end of a second sheet conveyed from the first rotator pair in succession to the first sheet abuts in a state in which the rotating member stops at a second abutment position where the second protruding portion protrudes into the sheet conveying path upstream, in the sheet conveying direction, of the nip portion of the second rotator pair, the rotating member being configured to turn in a predetermined direction from the first abutment position to the second abutment position through a passage state in which the first sheet is allowed to pass the first protruding portion, if the first protruding portion is pushed by the first sheet, wherein the rotating member is configured to turn to a standby position and standby at the second abutment position before a rear end of the first sheet reaches to the nip portion of the second rotator pair, wherein the second rotator pair includes a first rotator provided on the same side with the rotating member with respect to the nip portion of the second rotator pair, and a second rotator disposed opposite to the first rotator, and wherein the guide portion is configured to curve such that a radius of a curvature of a side of the first rotator is larger than that of a side of the second rotator.

* * * * *